US010116032B2

(12) United States Patent
Yoshikawa

(10) Patent No.: US 10,116,032 B2
(45) Date of Patent: Oct. 30, 2018

(54) DIELECTRIC RESONATOR, DIELECTRIC FILTER, AND COMMUNICATION APPARATUS

(71) Applicant: KYOCERA Corporation, Kyoto-shi, Kyoto (JP)

(72) Inventor: Hiromichi Yoshikawa, Kyoto (JP)

(73) Assignee: KYOCERA CORPORATION, Kyoto (JP)

( * ) Notice: Subject to any disclaimer, the term of this patent is extended or adjusted under 35 U.S.C. 154(b) by 398 days.

(21) Appl. No.: 15/036,440

(22) PCT Filed: Nov. 18, 2014

(86) PCT No.: PCT/JP2014/080493

§ 371 (c)(1),
(2) Date: May 13, 2016

(87) PCT Pub. No.: WO2015/076255

PCT Pub. Date: May 28, 2015

(65) Prior Publication Data

US 2016/0294034 A1 Oct. 6, 2016

(30) Foreign Application Priority Data

| | | |
|---|---|---|
| Nov. 25, 2013 | (JP) | 2013-242972 |
| Nov. 27, 2013 | (JP) | 2013-245077 |
| Dec. 13, 2013 | (JP) | 2013-258213 |
| Apr. 18, 2014 | (JP) | 2014-086490 |

(51) Int. Cl.

| | |
|---|---|
| ***H01P 7/10*** | (2006.01) |
| ***H01P 1/208*** | (2006.01) |
| ***H01P 1/20*** | (2006.01) |
| ***H01Q 1/50*** | (2006.01) |

(52) U.S. Cl.
CPC ..... *H01P 7/10* (2013.01); *H01P 1/2002* (2013.01); *H01P 1/2084* (2013.01); *H01Q 1/50* (2013.01)

(58) Field of Classification Search
CPC .... H01P 7/10; H01P 7/105; H01P 7/06; H01P 1/2002; H01P 1/2082; H01P 1/2084; H01P 1/2086
USPC ..... 333/219.1, 202
See application file for complete search history.

(56) References Cited

U.S. PATENT DOCUMENTS 4,613,838 A 9/1986 Wada et al.
2016/0308265 A1* 10/2016 Yoshikawa ..... H01P 1/2086

FOREIGN PATENT DOCUMENTS

JP 61-061503 A 3/1986

* cited by examiner

*Primary Examiner* — Stephen E. Jones
(74) *Attorney, Agent, or Firm* — Volpe and Koenig, P.C.

(57) ABSTRACT

A dielectric resonator includes a columnar dielectric body having a surface located at an end in a first direction thereof and a surface located at an end in a second direction opposite to the first direction thereof, a conductor which is disposed so as to surround the dielectric body leaving space therefrom, and has an inner surface opposed to the surface and an inner surface opposed to the surface, a columnar conductor disposed between the surface and the inner surface, a conductor disposed between the conductor and the conductor in a third direction perpendicular to the first direction, and a conductor disposed between the conductor and the conductor in a fourth direction perpendicular to the first direction.

14 Claims, 30 Drawing Sheets

DIELECTRIC RESONATOR, DIELECTRIC FILTER, AND COMMUNICATION APPARATUS

TECHNICAL FIELD

The present invention relates to a dielectric resonator, a dielectric filter, and a communication apparatus which have excellent electrical characteristics.

BACKGROUND ART

There is known a dielectric resonator comprising a dielectric block housed in a shield case (refer to Patent Literature 1, for example).

CITATION LIST

Patent Literature

Patent Literature 1: Japanese Unexamined Patent Publication JP-A 61-61503 (1986)

SUMMARY OF INVENTION

Technical Problem

Although a conventional dielectric resonator as proposed in Patent Literature 1 affords a high Q, there is an electrical characteristic problem therein in that a resonance frequency in a spurious mode of the lowest resonance frequency (closest to a fundamental mode) is proximate to a resonance frequency in the fundamental mode. Therefore, in the case of constituting a filter with use of the dielectric resonator, for example, a low-pass filter needs to be prepared to ensure attenuation on the high-frequency side.

The invention has been devised in view of the problems associated with the conventional art as discussed supra, and accordingly an object of the invention is to provide a dielectric resonator having excellent electrical characteristics, and a dielectric filter and a communication apparatus using the dielectric resonator.

Solution to Problem

According to one embodiment of the invention, a dielectric resonator includes a dielectric body having a first surface located at an end in a first direction thereof and a second surface which is located at an end in a second direction opposite to the first direction thereof; a first conductor having a cavity formed therein in which the dielectric body is housed, the first conductor being disposed so as to surround the dielectric body leaving space therefrom, and having a first inner surface including a part opposed to the first surface, and a second inner surface including a part opposed to the second surface; a second conductor disposed on the first surface, an end in the first direction thereof being electrically connected to the first inner surface; a third conductor disposed on the second surface, an end in the second direction thereof being electrically connected to the second inner surface; a fourth conductor disposed between the second conductor and the first conductor in a third direction perpendicular to the first direction, an end in the first direction thereof and an end in the third direction thereof being electrically connected to the first conductor, an end in a direction opposite to the third direction thereof being electrically connected to the second conductor; and a fifth conductor disposed between the third conductor and the first conductor in a fourth direction perpendicular to the first direction, an end in the fourth direction thereof and an end in the second direction thereof being electrically connected to the first conductor, an end in a direction opposite to the fourth direction thereof being electrically connected to the third conductor.

According to an embodiment of the invention a dielectric filter includes a plurality of sets each composed of the dielectric body, the second conductor, the third conductor, the fourth conductor, and the fifth conductor of the dielectric resonator, the plurality of sets being disposed in the cavity and being aligned in a line, the plurality of sets including at least a first set disposed at one end of the line and a second set disposed at the other end of the line, the dielectric filter further comprising:

a sixth conductor which is a linear conductor having a first end part which is one end, and a second end part which is the other end, the first end part being connected to the second conductor or the third conductor of the first set, the second end part being exposed to an outside of the first conductor through a first through hole formed in the first conductor, the sixth conductor being electromagnetically coupled to the dielectric body of the first set; and a seventh conductor which is a linear conductor having a third end part which is one end, and a fourth end part which is the other end, the third end part being connected to the second conductor or the third conductor of the second set, the fourth end part being exposed to an outside of the first conductor through a second through hole formed in the first conductor, the seventh conductor being electromagnetically coupled to the dielectric body of the second set.

According to the invention, a communication apparatus includes an antenna, a communication circuit, and the dielectric filter configured to connect the antenna with the communication circuit.

Advantageous Effects of Invention

According to the invention, a dielectric resonator having excellent electrical characteristics can be obtained. According to the invention, a dielectric filter having excellent electrical characteristics can be obtained. According to the invention, a communication apparatus of high communication quality can be obtained.

DESCRIPTION OF EMBODIMENTS

Hereinafter, a dielectric resonator pursuant to the invention, and a dielectric filter and a communication apparatus which incorporate the dielectric resonator will be described in detail with reference to accompanying drawings.

(First Embodiment)

Figure 1:
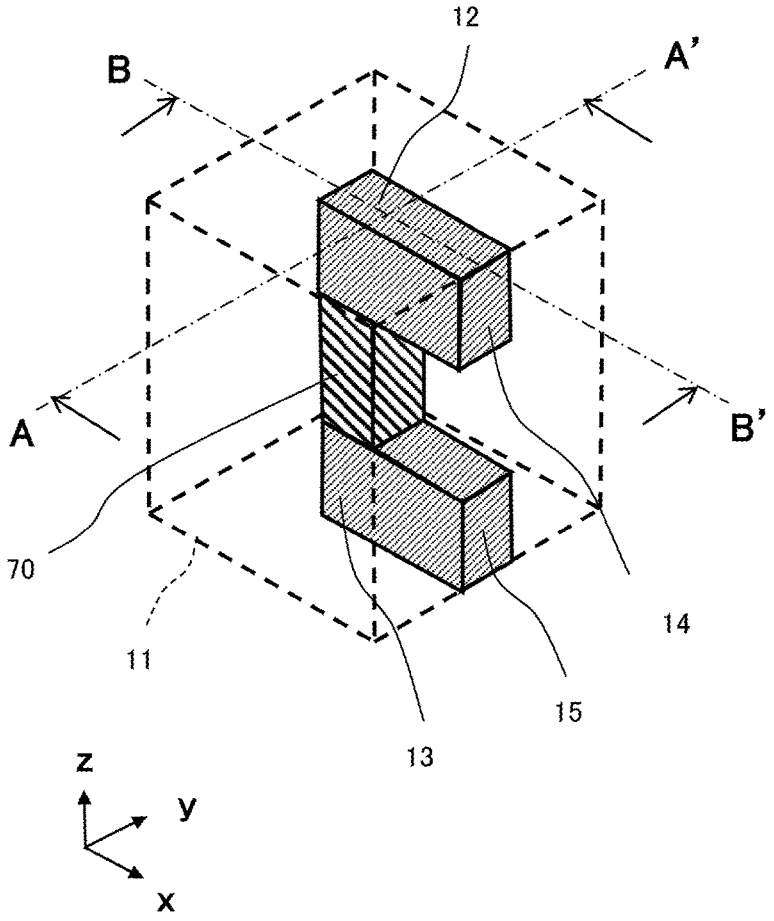
FIG. 1 is a perspective view schematically showing a dielectric resonator in accordance with a first embodiment of the invention.
Figure 2:
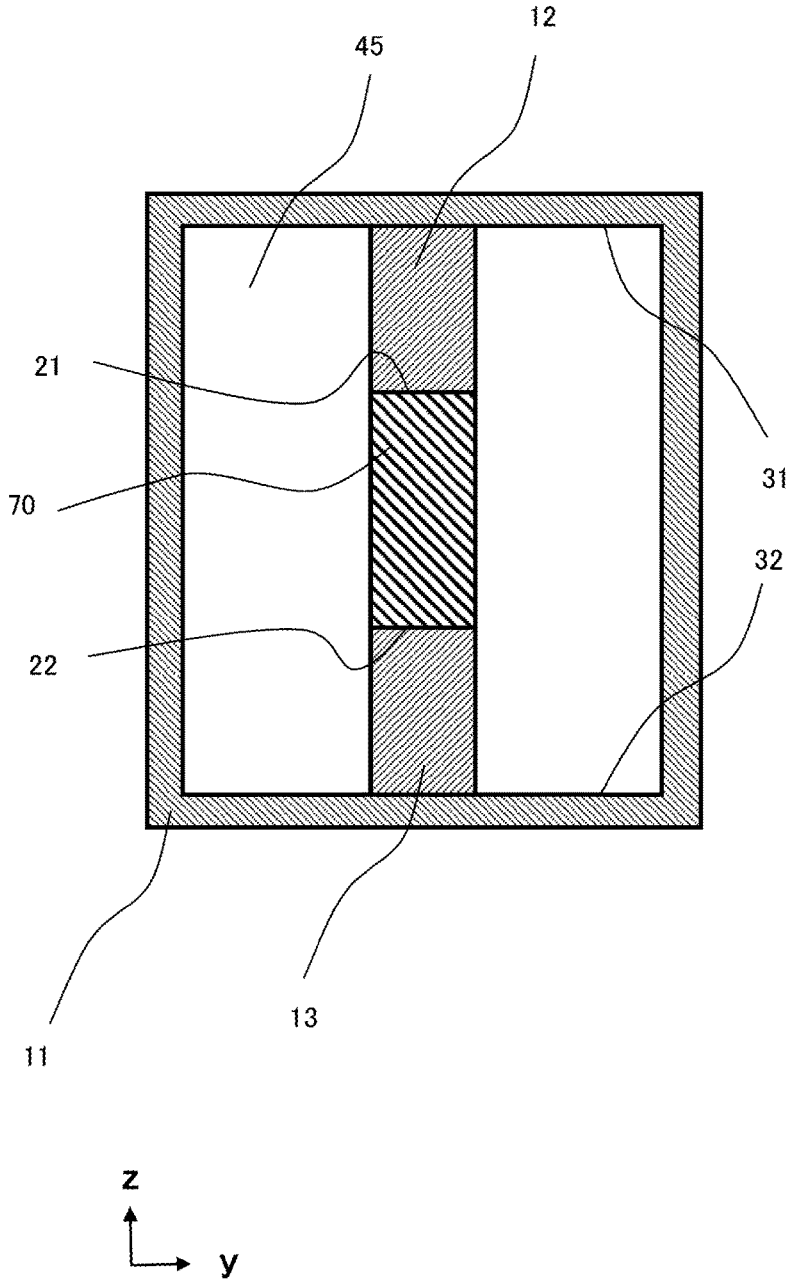
FIG. 2 is a sectional view of the dielectric resonator taken along the line A-A' shown in FIG. 1.
Figure 3:
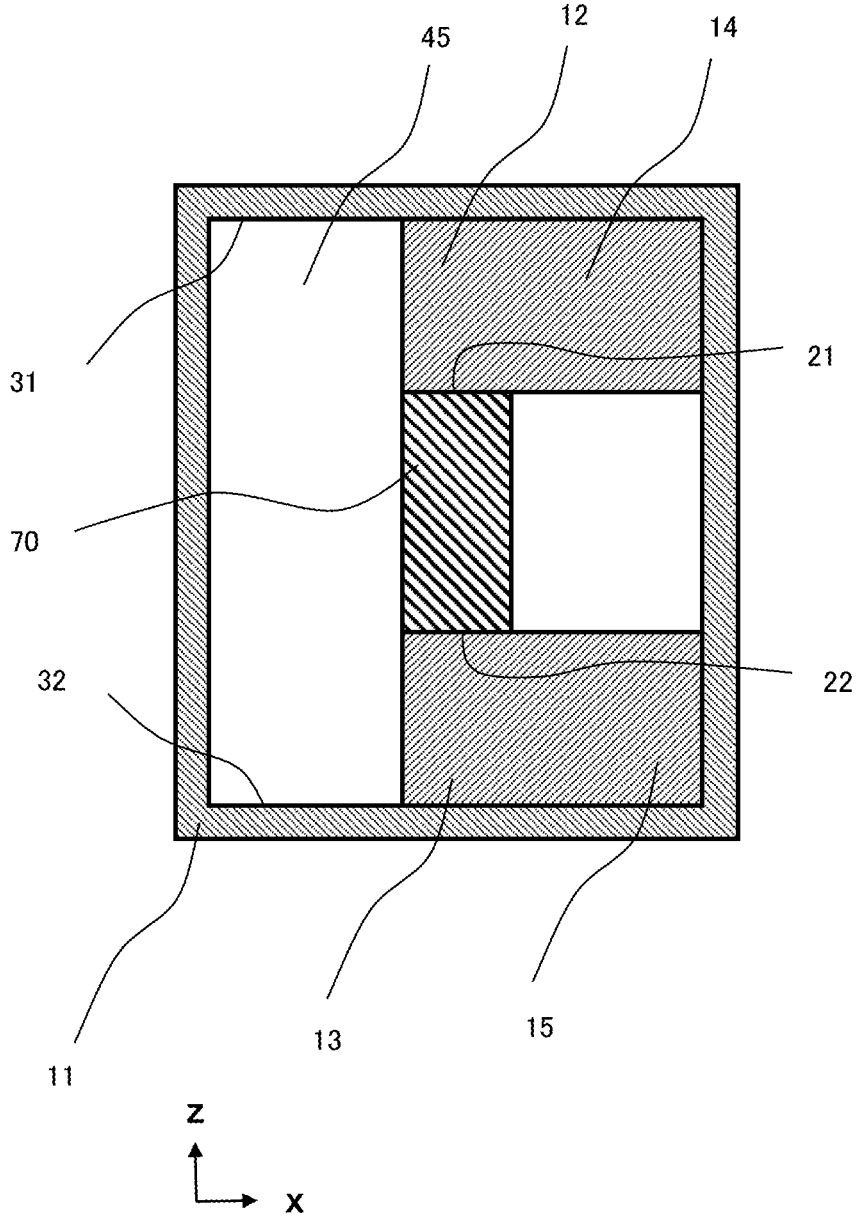
FIG. 3 is a sectional view of the dielectric resonator taken along the line B-B' shown in FIG. 1.

FIG. 1 is a perspective view schematically showing a dielectric resonator in accordance with a first embodiment of the invention. FIG. 2 is a sectional view of the dielectric resonator taken along the line A-A' shown in FIG. 1. FIG. 3 is a sectional view of the dielectric resonator taken along the line B-B' shown in FIG. 1. To simplify an understanding of the construction, a conductor 11 is represented in a see-through manner in FIG. 1. As shown in FIGS. 1 to 3, the dielectric resonator according to this embodiment comprises the conductor 11, a conductor 12, a conductor 13, a conductor 14, a conductor 15, and a dielectric body 70.

The dielectric body 70 is a columnar dielectric which extends in a first direction (a +z direction), and has a surface 21 located at an end in the +z direction thereof and a surface 22 which is located at an end in a second direction (a −z direction) opposite to the +z direction thereof. A well-known dielectric material such as dielectric ceramics may be used as the material of construction of the dielectric body 70. For example, a dielectric ceramic material containing, for example, $BaTiO_3$, $Pb_4Fe_2Nb_2O_{12}$, or $TiO_2$ is desirable for use. In some cases, use can be made of a resin such as epoxy resin. While the dielectric body 70 is illustrated as being shaped in a quadrangular prism in this embodiment, the dielectric body 70 may be given another shape, for example, the shape of a hexagonal prism or cylinder.

The conductor 11 has the form of a cuboid-shaped box. Moreover, the conductor 11 has a cavity 45 formed therein in which the dielectric body 70 is housed, the conductor 11 being disposed so as to surround the dielectric body 70 leaving space therefrom. Furthermore, the conductor 11 has an inner surface 31 including a part opposed to the surface 21, and an inner surface 32 including a part opposed to the surface 22. While the conductor 11 is illustrated as having a cuboid-shaped outline in this embodiment, the conductor 11 may be given another shape, for example, the shape of other polygonal prism or cylinder.

The conductor 12 is a columnar conductor extending in the +z direction. Moreover, the conductor 12 is disposed on the surface 21 of the dielectric body 70. An end in the +z direction of the conductor 12 is joined to or brought into contact with the inner surface 31 of the conductor 11 for electrical connection with the inner surface 31 of the conductor 11.

The conductor 13 is a columnar conductor extending in the +z direction. Moreover, the conductor 13 is disposed on the surface 22 of the dielectric body 70. An end in the −z direction of the conductor 13 is joined to or brought into contact with the inner surface 32 of the conductor 11 for electrical connection with the inner surface 32 of the conductor 11.

While the conductor 12 and the conductor 13 are illustrated as being shaped in a quadrangular prism in this embodiment, these conductors may be given another shape, for example, the shape of a hexagonal prism or cylinder. It is preferable that the conductor 12 and the conductor 13 are identical with the dielectric body 70 in section taken along a plane perpendicular to the +z direction.

The conductor 14 is shaped in a cuboid. Moreover, the conductor 14 is disposed between the conductor 12 and the conductor 11 in a third direction (a +x direction) perpendicular to the +z direction. An end in the +x direction of the conductor 14 is joined to or brought into contact with the conductor 11 for electrical connection with the conductor 11. An end of the conductor 14 opposite to the end in the +x direction (the −x direction) is joined to or brought into contact with the conductor 12 for electrical connection with the conductor 12. An end in the +z direction of the conductor 14 is joined to or brought into contact with the inner surface 31 of the conductor 11 for electrical connection with the inner surface 31 of the conductor 11.

The conductor 15 is shaped in a cuboid. Moreover, the conductor 15 is disposed between the conductor 13 and the conductor 11 in a fourth direction (a +x direction) perpendicular to the +z direction. An end in the +x direction of the conductor 15 is joined to or brought into contact with the conductor 11 for electrical connection with the conductor 11. An end of the conductor 15 opposite to the end in the +x direction (the −x direction) is joined to or brought into contact with the conductor 13 for electrical connection with the conductor 13. An end in the −z direction of the conductor 15 is joined to or brought into contact with the inner surface 32 of the conductor 11 for electrical connection with the inner surface 32 of the conductor 11.

In the mutually electrically connected areas of the conductor 11, the conductor 12, the conductor 13, the conductor 14, and the conductor 15, while it is sufficient that these areas make contact with one another from an electrical-conduction standpoint, these areas should preferably be joined to one another from a reliability standpoint. In the case of joining these areas together, the joining operation needs to be performed so as to ensure electrical conduction, wherefore it is advisable to use solder or an electrically conductive adhesive for the joining operation, or alternatively, a screw or a bolt may also be used. Moreover, the conductor 11, the conductor 12, the conductor 13, the conductor 14, and the conductor 15 may be formed, either entirely or partly, integrally formed with one another. Furthermore, the conductor 11, the conductor 12, the conductor 13, the conductor 14, and the conductor 15 may be composed, either entirely or partly, of a plurality of constituent components. In this embodiment, the conductor 12 and the conductor 14 are formed integrally with each other, and the conductor 13 and the conductor 14 are formed integrally with each other.

Likewise, in the mutually contacting areas of the dielectric body 70 and the conductor 12, as well as the mutually contacting areas of the dielectric body 70 and the conductor 13, while it is sufficient that these areas make contact with one another from an electrical-conduction standpoint, these areas should preferably be joined to one another from a reliability standpoint. For example, an electrically conductive adhesive may be used for the joining operation. As an alternative, for example, a first plate-like conductor is baked on the surface 21 of the dielectric body 70, and a second plate-like conductor is baked on the surface 22 of the dielectric body 70, and then a first columnar conductor is joined to the first plate-like conductor via solder or the like, and a second columnar conductor is joined to the second plate-like conductor via solder or the like. In this case, a composite body of the first plate-like conductor and the first columnar conductor corresponds to the conductor 12 of this embodiment, and a composite body of the second plate-like conductor and the second columnar conductor corresponds to the conductor 13 of this embodiment.

While the conductors 11 to 15 may be made of a well-known various electrically conductive materials, including metals and non-metallic conductive materials, to improve the characteristics of the dielectric resonator, it is desirable to use, for example, an electrically conductive material predominantly composed of Ag or a Ag alloy such as a Ag—Pd alloy or a Ag—Pt alloy, a Cu-based conductive material, a W-based conductive material, a Mo-based conductive material, or a Pd-based conductive material.

While the cavity 45 is filled with air, a vacuum may be created in the cavity 45, or the cavity 45 may filled with other gas than air.

In the thereby constructed dielectric resonator according to this embodiment, as contrasted to the conventional dielectric resonator having no conductors 12 to 15 as described in Patent Literature 1, a resonance frequency in a spurious mode with the lowest resonance frequency can be increased. This makes it possible to obtain a dielectric resonator having excellent electrical characteristics involving a wide gap between a resonance frequency in a fundamental mode and a resonance frequency in a spurious mode. Since the dielectric resonator according to this embodiment differs from the conventional dielectric resonator in spurious mode with the lowest resonance frequency, the attainment of the above effect is believed to be due to variation in the resonant mode.

Moreover, in the dielectric resonator according to this embodiment having the conductor 14 and the conductor 15, as contrasted to a case where neither the conductor 14 nor the conductor 15 is provided, it is possible to attain a higher Q in fundamental mode resonance. In the absence of the conductor 14 and the conductor 15, a magnetic field generated so as to surround the conductor 12 and the conductor 13 causes current loss in the conductor 12 and the conductor 13, which presumably results in a lower Q. In the dielectric resonator according to the present embodiment, since the conductor 14 and the conductor 15 are capable of reducing the magnetic field generated so as to surround the conductor 12 and the conductor 13, the attainment of a higher Q is believed to be due to reduction in current loss.

It is preferable that the conductor 14 is disposed so as to extend entirely across the conductor 12 and the conductor 11 in the third direction (the +x direction), as well as to extend entirely across the dielectric body 70 and the conductor 11 in the first direction (the +z direction). Moreover, it is preferable that the conductor 15 is disposed so as to extend entirely across the conductor 13 and the conductor 11 in the fourth direction (the +x direction), as well as to extend entirely across the dielectric body 70 and the conductor 11 in the first direction (the +z direction). In this case, it is possible to attain a higher Q in fundamental mode resonance.

Moreover, in the dielectric resonator according to the present embodiment, the third direction and the fourth direction coincide with each other. That is, the direction in which the conductor 14 is disposed relative to the conductor 12 and the direction in which the conductor 15 is disposed relative to the conductor 13 coincide with each other. This makes it possible to obtain a dielectric resonator which can be electromagnetically coupled to other resonator or the like with ease.

(Second Embodiment)

Figure 4:
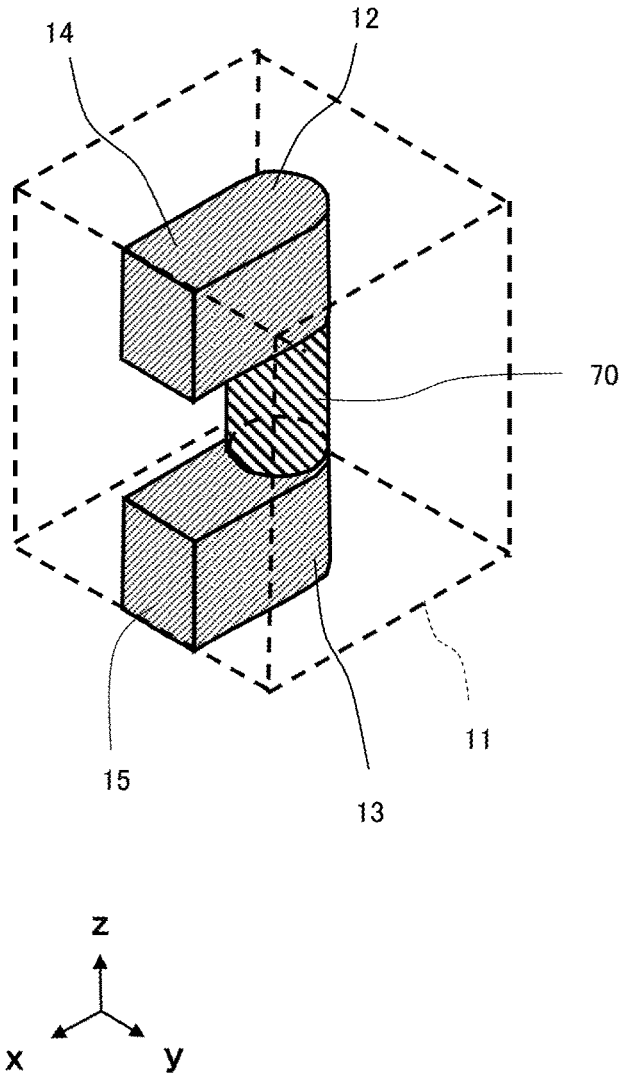
FIG. 4 is a perspective view schematically showing a dielectric resonator in accordance with a second embodiment of the invention.

FIG. 4 is a perspective view schematically showing a dielectric resonator in accordance with a second embodiment of the invention. To simplify an understanding of the construction, a conductor 11 is represented in a see-through manner in FIG. 4. Moreover, the following description of this embodiment deals only with the points of difference from the foregoing first embodiment, and like constituent components will be identified with the same reference symbols, and overlapping descriptions will be omitted.

In the dielectric resonator according to this embodiment, the dielectric body 70, the conductor 12, and the conductor 13 are cylindrically shaped. Moreover, the conductor 14 and the conductor 15 have the form of a rectangular prism, with a certain part thereof having a cylindrical shape removed.

Other constituent components of this embodiment is identical with those of the resonator according to the foregoing first embodiment.

Thus, the dielectric resonator according to this embodiment is similar in structure to the dielectric resonator according to the foregoing first embodiment, and has, like the dielectric resonator according to the foregoing first embodiment, excellent electrical characteristics accordingly.

(Third Embodiment)

Figure 5:
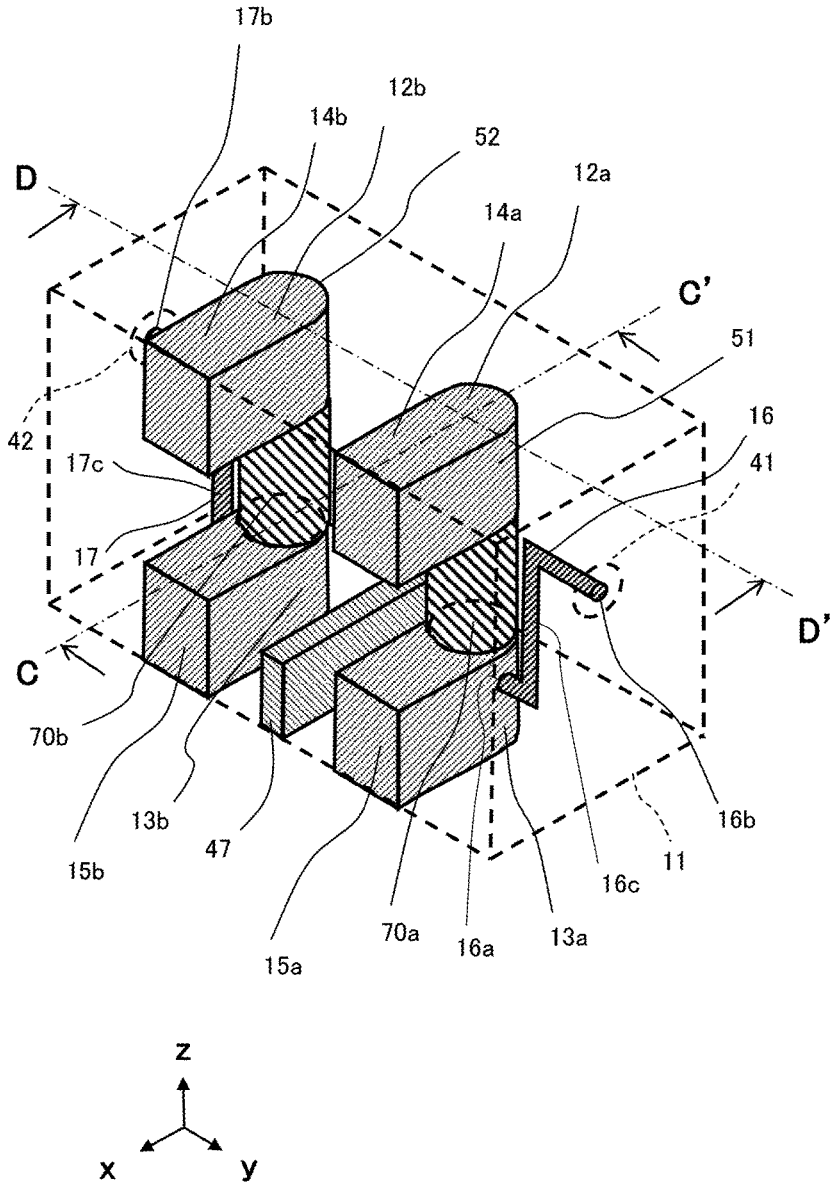
FIG. 5 is a perspective view schematically showing a dielectric filter in accordance with a third embodiment of the invention.
Figure 6:
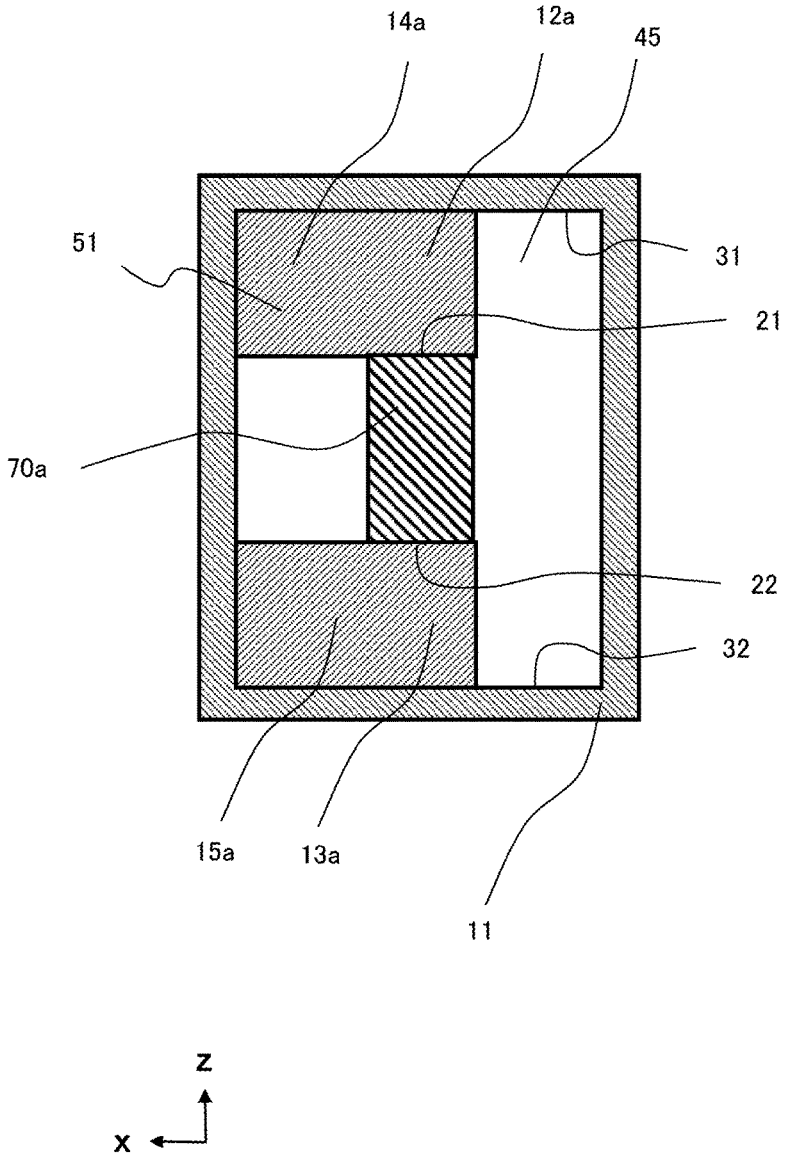
FIG. 6 is a sectional view of the dielectric filter taken along the line C-C' shown in FIG. 5.
Figure 7:
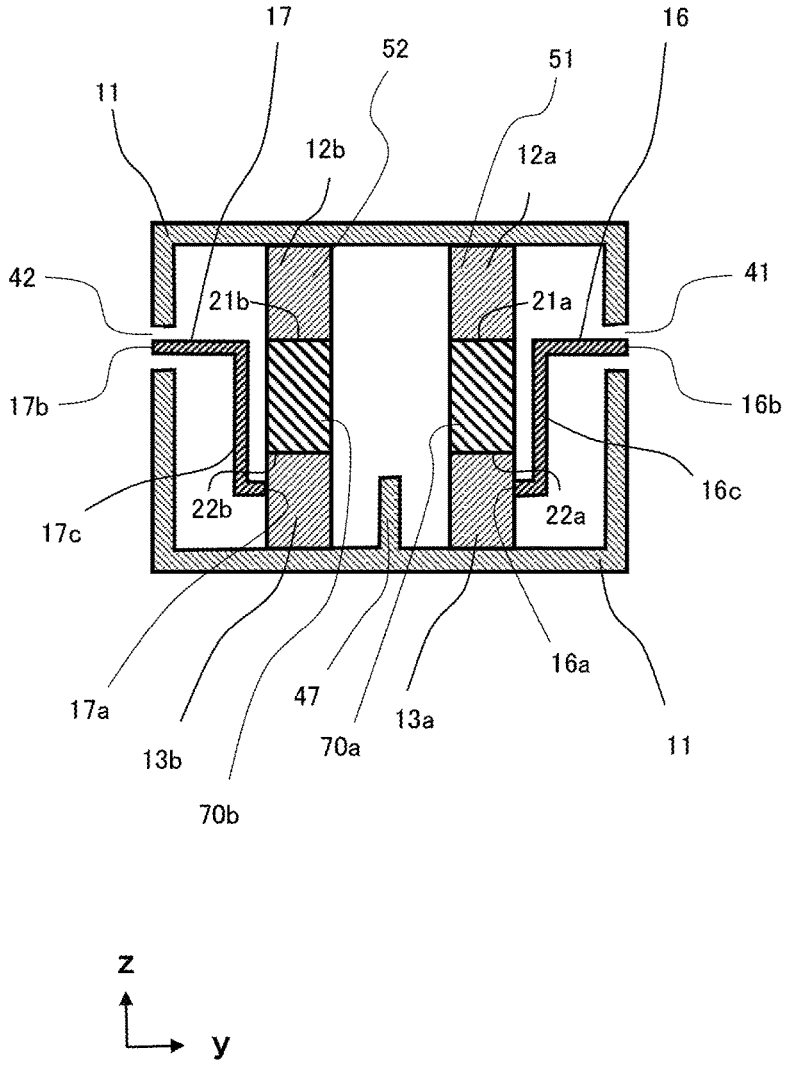
FIG. 7 is a sectional view of the dielectric filter taken along the line D-D' shown in FIG. 5.

FIG. 5 is a perspective view schematically showing a dielectric filter in accordance with a third embodiment of the invention. FIG. 6 is a sectional view of the dielectric filter taken along the line C-C' shown in FIG. 5. FIG. 7 is a sectional view of the dielectric filter taken along the line D-D' shown in FIG. 5. To simplify an understanding of the construction, a conductor 11 is represented in a see-through manner in FIG. 5. Moreover, the following description of this embodiment deals only with the points of difference from the foregoing second embodiment, and like constituent components will be identified with the same reference symbols, and overlapping descriptions will be omitted.

In the dielectric filter according to this embodiment, a plurality of sets each composed of the dielectric body 70, the conductor 12, the conductor 13, the conductor 14, and the conductor 15, are disposed in the cavity 45. The plurality of sets are aligned in a line, and include a first set 51 disposed at one end (an end in a +y direction) of the line and a second set 52 disposed at the other end (an end in a −y direction) of the line. Each of the plurality of sets (the first set 51 and the second set 52) serves as a resonator in conjunction with a conductor 11.

The first set 51 is composed of a dielectric body 70*a*, a conductor 12*a*, a conductor 13*a*, a conductor 14*a*, and a conductor 15*a*, and, the second set 52 is composed of a dielectric body 70*b*, a conductor 12*b*, a conductor 13*b*, a conductor 14*b*, and a conductor 15*b*. The dielectric body 70*a* and the dielectric body 70*b* are equal to the dielectric body 70 of the second embodiment. The conductor 12*a* and the conductor 12*b* are equal to the conductor 12 of the second embodiment. The conductor 13*a* and the conductor 13*b* are equal to the conductor 13 of the second embodiment. The conductor 14*a* and the conductor 14*b* are equal to the conductor 14 of the second embodiment. The conductor 15*a* and the conductor 15*b* are equal to the conductor 15 of the second embodiment. That is, the resonator constituted by the first set 51 and the conductor 11 and the resonator constituted by the second set 52 and the conductor 11 are similar in structure to the resonator according to the foregoing second embodiment, and have, like the resonator according to the second embodiment, excellent electrical characteristics accordingly.

Moreover, the dielectric filter according to this embodiment further comprises a conductor 16 which is a linear conductor. The conductor 16 has an end part 16*a* which is one end, an end part 16*b* which is the other end, and a joint part 16*c* extending along the dielectric body 70*a* in the +z direction. The end part 16*a* is connected to the conductor 13*a*, and the end part 16*b* is exposed to an outside of the conductor 11 through a through hole 41 formed in the conductor 11. Note that the end part 16*a* may be connected to the conductor 12*a*.

Moreover, the dielectric filter according to this embodiment further comprises a conductor 17 which is a linear conductor. The conductor 17 has an end part 17*a* which is one end, an end part 17*b* which is the other end, and a joint part 17*c* extending along the dielectric body 70*b* in the +z direction. The end part 17*a* is connected to the conductor 13*b*, and the end part 17*b* is exposed to an outside of the conductor 11 through a through hole 42 formed in the conductor 11. Note that the end part 17*a* may be connected to the conductor 12*b*.

While it is preferable that the joint part 16*c* and the joint part 17*c* are formed in parallel with the +z direction, these parts may be slightly inclined with respect to the +z direction. Moreover, it is preferable that the joint part 16*c* is disposed in a space between the dielectric body 70*a* and the conductor 11 so as to lie at a position closer to the dielectric body 70*a* than the center of the space. In this case, the joint part 16*c* and the dielectric body 70*a* can be electromagnetically coupled to each other satisfactorily. Likewise, it is preferable that the joint part 17*c* is disposed in a space between the dielectric body 70*b* and the conductor 11 so as to lie at a position closer to the dielectric body 70*b* than the center of the space. In this case, the joint part 17*c* and the dielectric body 70*b* can be electromagnetically coupled to each other satisfactorily.

Moreover, the dielectric filter according to this embodiment further comprises a conductor 47. The conductor 47 is interposed between the first set 51 and the second set 52 in the +y direction. Specifically, the conductor 47 is joined to the inner surface 32 of the conductor 11 at an end thereof in the −z direction, is shorter in height than the conductor 13*b*, and is formed so as to extend throughout the length of the construction in the +x direction. The conductor 47 enables adjustment of the coupling between the dielectric body 70*a* and the dielectric body 70*b*. Note that the conductor 47 is not absolutely necessary, and does not necessarily have to be provided in some cases.

In the thereby constructed dielectric filter according to this embodiment, for example, upon input of an electric signal from the end part 16*b* of the conductor 16, resonance occurs in each resonator, and an electric signal is outputted from the end part 17*b* of the conductor 17. At this time, due to the selective passage of signals lying in a frequency band including the resonance frequencies of the individual resonators, the dielectric filter functions as a band-pass filter.

The dielectric filter according to this embodiment is constituted by the dielectric resonator which provides a high Q in fundamental mode resonance, and has excellent electrical characteristics involving a wide gap between a resonance frequency in a fundamental mode and a resonance frequency in a spurious mode. This makes it possible to attain excellent electrical characteristics involving little insertion loss in a pass band and high attenuation in the vicinity of the pass band.

Moreover, in the dielectric filter according to this embodiment, the third direction (the +x direction) in which the conductor 14*a* and the conductor 14*b* are disposed and the fourth direction (the +x direction) in which the conductor 15*a* and the conductor 15*b* are disposed coincide with each other, and, the plurality of sets are disposed along a fifth direction (the +y direction) which is perpendicular to both of the first direction (the +z direction) and the third direction (the +x direction). This makes it possible to maintain electromagnetic coupling between resonators and electromagnetic coupling between a resonator and an input-output line satisfactorily even if the number of the sets (the number of resonators) is increased, and thereby obtain a dielectric filter having satisfactory electrical characteristics.

While the dielectric filter is illustrated as having two sets, namely the first set 51 and the second set 52 in this embodiment, a larger number of the sets may be provided therein. In this case, an additional set (or sets) may be disposed between the first set 51 and the second set 52.

However, an increase in the number of the sets may lead to an increase in insertion loss and an increase in size, wherefore the number of the sets should preferably be not greater than 10.

(Fourth Embodiment)

Figure 8:
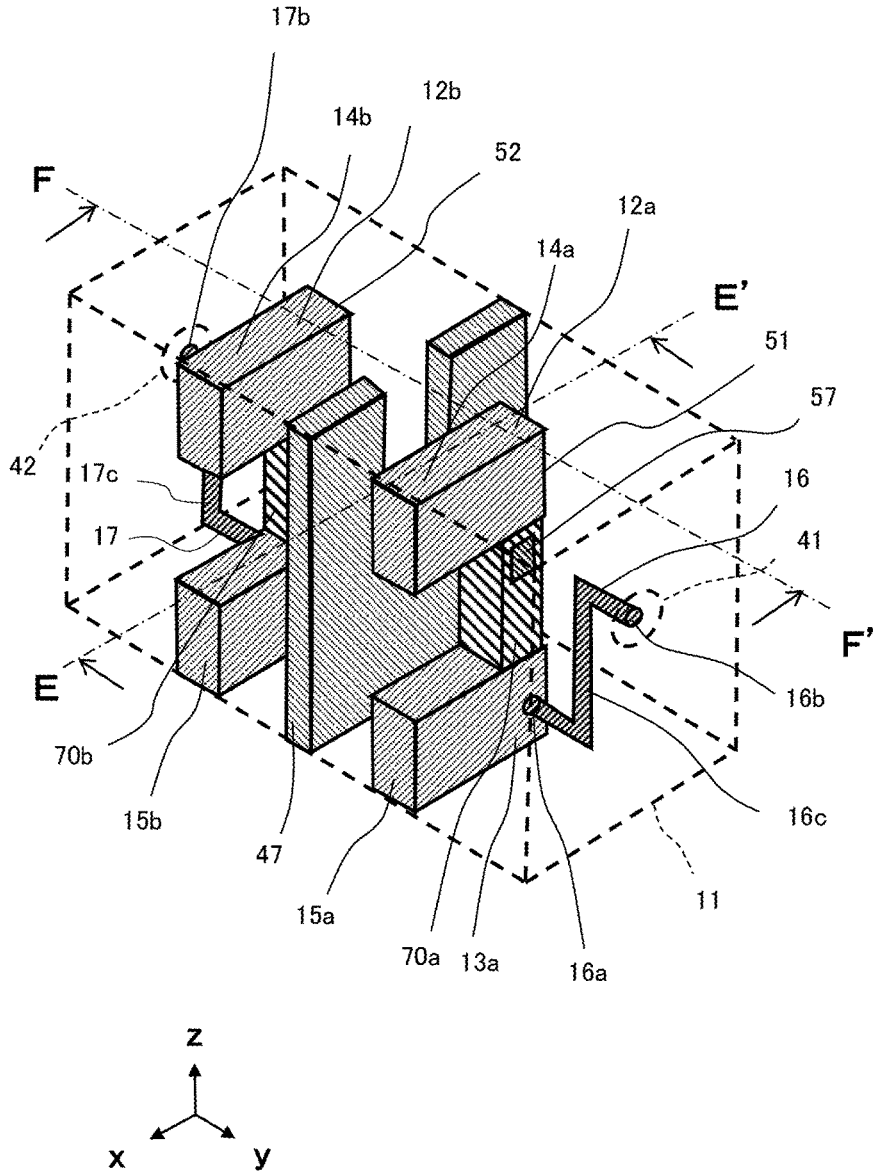
FIG. 8 is a perspective view schematically showing a dielectric filter in accordance with a fourth embodiment of the invention.
Figure 9:
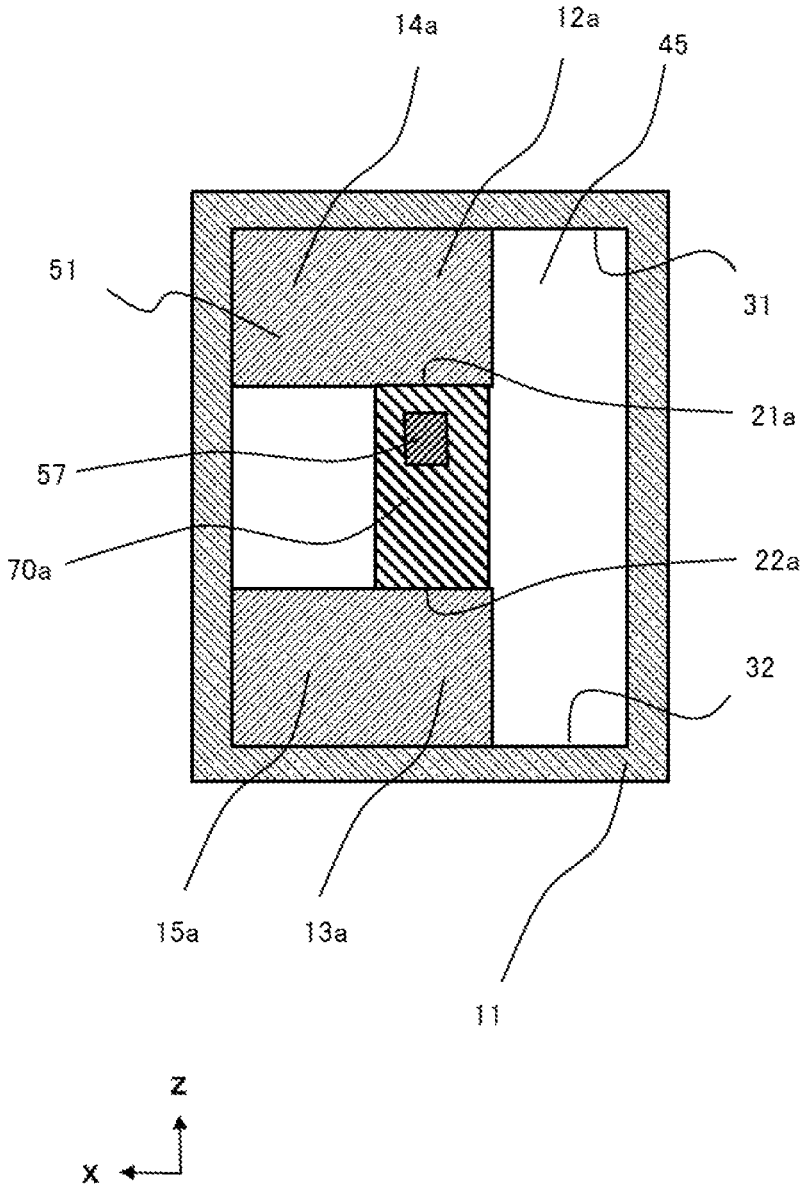
FIG. 9 is a sectional view of the dielectric filter taken along the line E-E' shown in FIG. 8.
Figure 10:
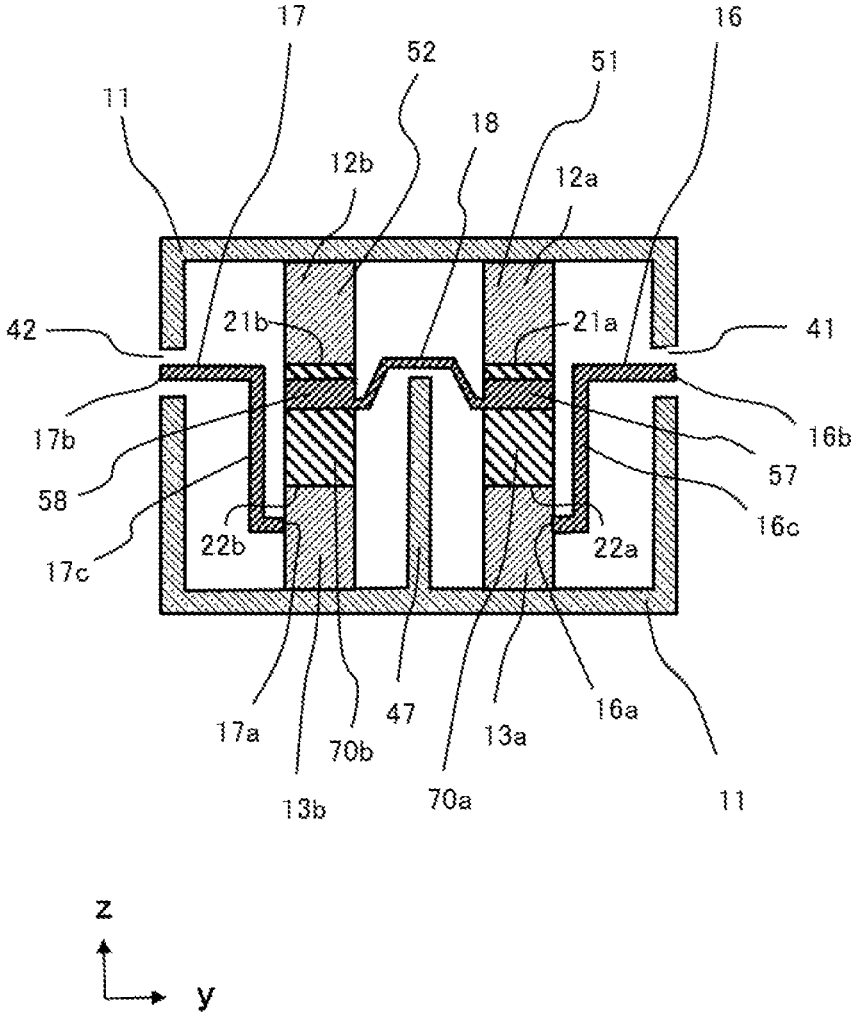
FIG. 10 is a sectional view of the dielectric filter taken along the line F-F' shown in FIG. 8.

FIG. 8 is a perspective view schematically showing a dielectric filter in accordance with a fourth embodiment of the invention. FIG. 9 is a sectional view of the dielectric filter taken along the line E-E' shown in FIG. 8. FIG. 10 is a sectional view of the dielectric filter taken along the line F-F' shown in FIG. 8. To simplify an understanding of the construction, a conductor 11 is represented in a see-through manner in FIG. 8. Moreover, the following description of this embodiment deals only with the points of difference from the foregoing third embodiment, and like constituent components will be identified with the same reference symbols, and overlapping descriptions will be omitted.

In the dielectric filter of this embodiment, the dielectric body 70*a*, the conductor 12*a*, and the conductor 13*a* are shaped in a quadrangular prism, and, the dielectric body 70*b*, the conductor 12*b*, and the conductor 13*b* are shaped in a quadrangular prism. Moreover, the conductor 14*a* and the conductor 15*a* are shaped in a cuboid, and the conductor 14*b* and the conductor 15*b* are shaped in a cuboid.

Moreover, the dielectric filter according to this embodiment has an electrode 57, an electrode 58, and a conductor 18. The electrode 57 is disposed within the dielectric body 70*a* so as to be located closer to the conductor 12*a*. The electrode 58 is disposed within the dielectric body 70*b* so as to be located closer to the conductor 12*b*. The conductor 18 is a linear conductor. One end of the conductor 18 is joined to the electrode 57, and the other end of the conductor 18 is joined to the electrode 58. That is, the conductor 18 is configured to connect the electrode 57 and the electrode 58. The electrode 57 may be disposed within the dielectric body 70*a* so as to be located closer to the conductor 13*a*, and the electrode 58 may be disposed within the dielectric body 70*b* so as to be located closer to the conductor 13*b*.

Moreover, in the dielectric filter according to this embodiment, a conductor 47 is disposed like a partition which serves to separate the first set 51 and the second set 52 substantially completely. The conductor 18 is disposed so as to pass through a recess formed at an end in the +z direction of the conductor 47 to avoid contact with the conductor 47.

Thus, the dielectric filter according to this embodiment has the electrode 57, the electrode 58, and the conductor 18. The electrode 57 is disposed within the dielectric body 70*a* so as to be located closer to one of the conductor 12*a* and the conductor 13*a*. The electrode 58 is disposed within the dielectric body 70*b* so as to be located closer to one of the conductor 12*b* and the conductor 13*b*. The conductor 18 is configured to connect the electrode 57 and the electrode 58. In the thereby constructed dielectric filter according to this embodiment, since the conductor 18 provides a capacitive coupling between the first set 51 and the second set 52, as contrasted to the dielectric filter according to the foregoing third embodiment, it is possible to increase an attenuation on the higher frequency side than the pass band.

(Fifth Embodiment)

Figure 11:
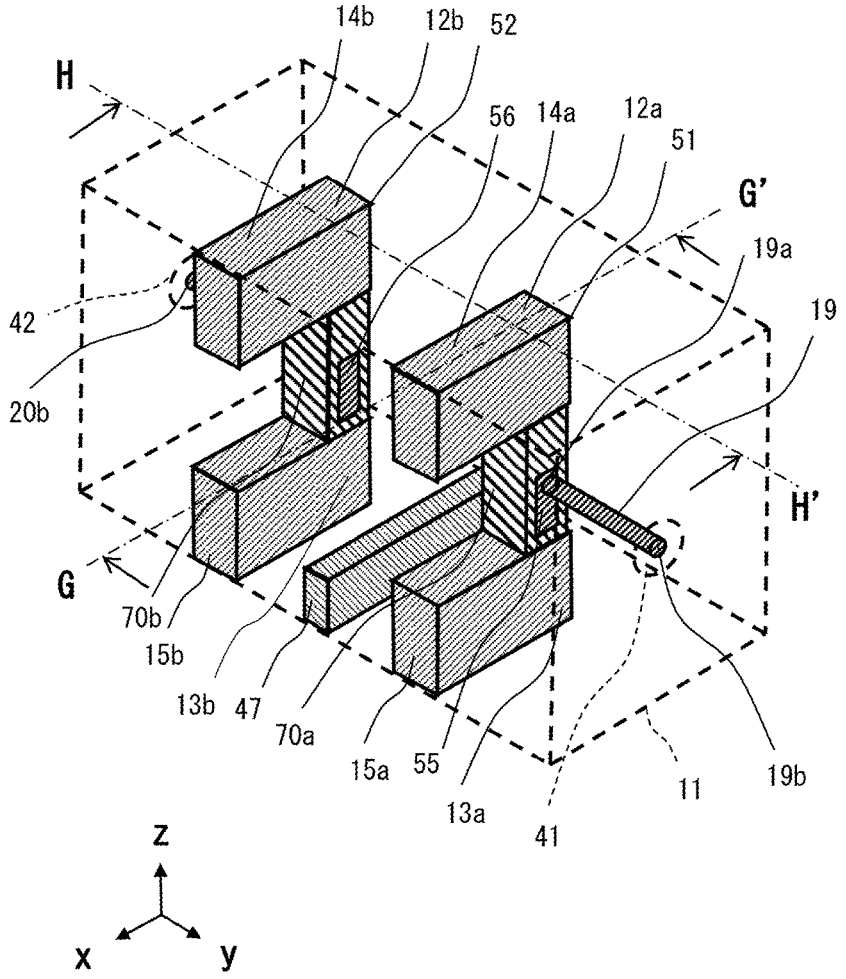
FIG. 11 is a perspective view schematically showing a dielectric filter in accordance with a fifth embodiment of the invention.
Figure 12:
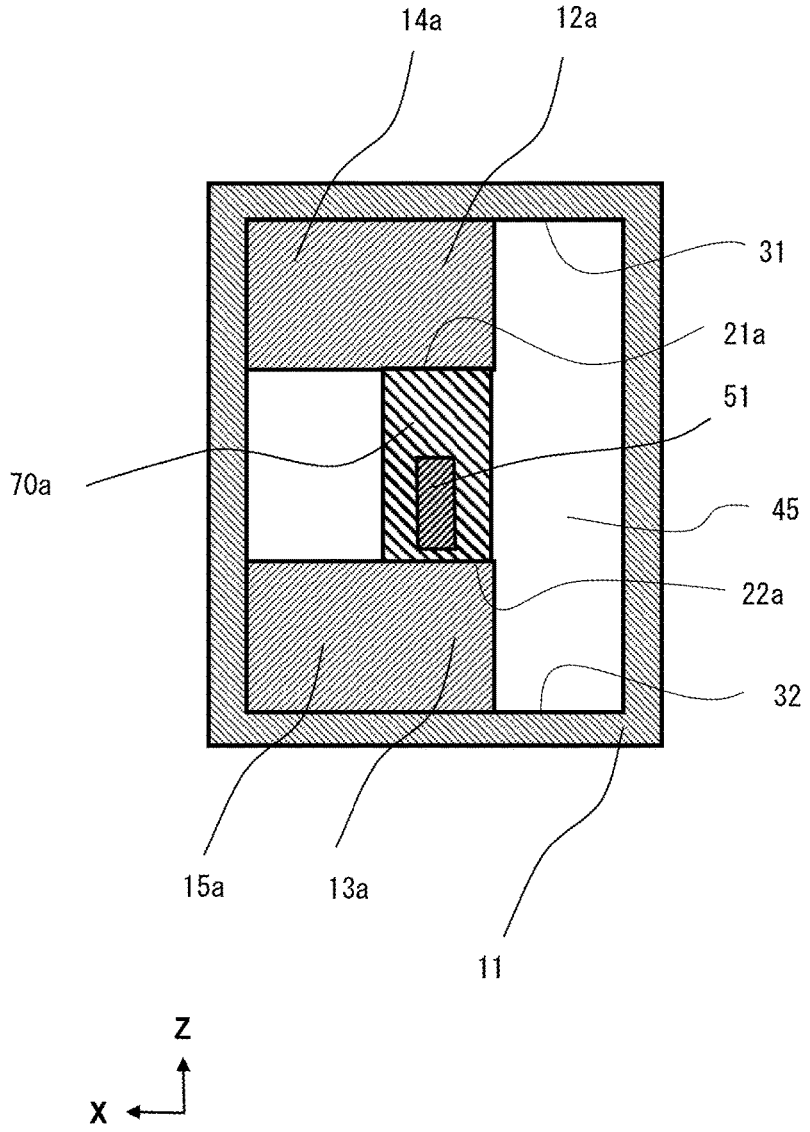
FIG. 12 is a sectional view of the dielectric filter taken along the line G-G' shown in FIG. 11.
Figure 13:
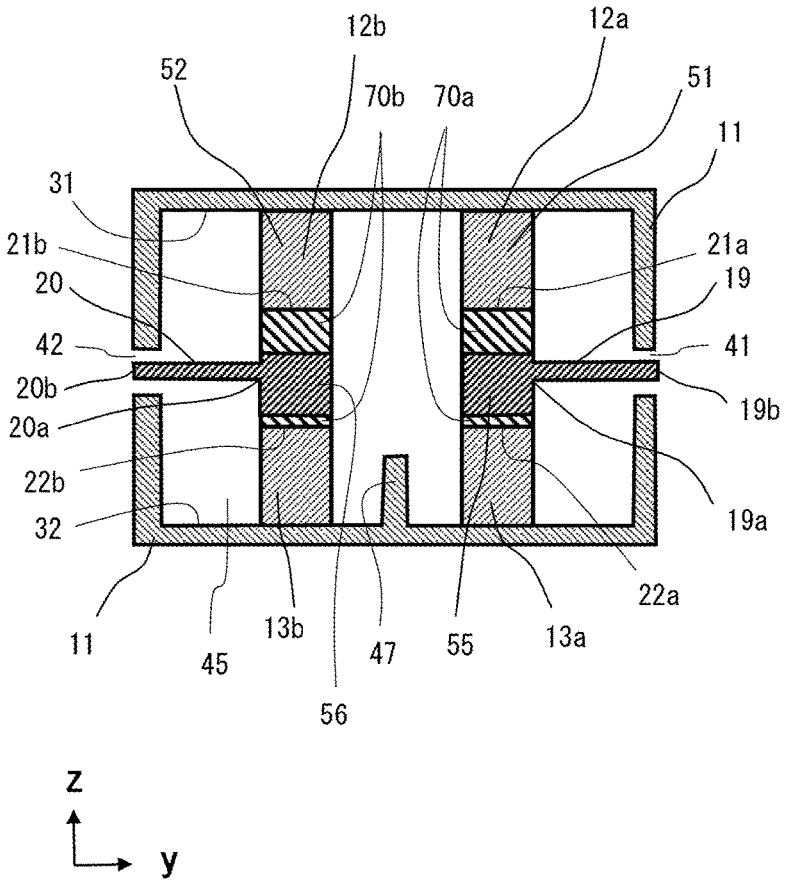
FIG. 13 is a sectional view of the dielectric filter taken along the line H-H' shown in FIG. 11.

FIG. 11 is a perspective view schematically showing a dielectric filter in accordance with a fifth embodiment of the invention. FIG. 12 is a sectional view of the dielectric filter taken along the line G-G' shown in FIG. 11. FIG. 13 is a sectional view of the dielectric filter taken along the line H-H' shown in FIG. 11. To simplify an understanding of the construction, a conductor 11 is represented in a see-through manner in FIG. 11. Moreover, the following description of this embodiment deals only with the points of difference from the foregoing third embodiment, and like constituent components will be identified with the same reference symbols, and overlapping descriptions will be omitted.

In the dielectric filter of this embodiment, the dielectric body 70*a*, the conductor 12*a*, and the conductor 13*a* are shaped in a quadrangular prism, and, the dielectric body 70*b*, the conductor 12*b*, and the conductor 13*b* are shaped in a quadrangular prism. Moreover, the conductor 14*a* and the conductor 15*a* are shaped in a cuboid, and the conductor 14*b* and the conductor 15*b* are shaped in a cuboid.

Moreover, the dielectric filter of this embodiment has a conductor 19 instead of the conductor 16, and has a conductor 20 instead of the conductor 17. In addition, the dielectric filter of this embodiment has an electrode 55 and an electrode 56.

The electrode 55 is disposed within the dielectric body 70*a* so as to be located closer to one of the conductor 12*a* and the conductor 13*a*. The electrode 55 functions to produce an electric field in the interior of the dielectric body 70*a* in response to the supply of an electric signal through the conductor 19.

The electrode 56 is disposed within the dielectric body 70*b* so as to be located closer to one of the conductor 12*b* and the conductor 13*b*. The electrode 56 functions to produce an electric field in the interior of the dielectric body 70*a* in response to the supply of an electric signal through the conductor 20.

While the conductor 55 is illustrated as being located closer to the conductor 13*a* (a −z direction side) and the conductor 56 is illustrated as being located closer to the conductor 13*b* (a −z direction side) in FIGS. 11 to 13, the conductor 55 may be located closer to the conductor 12*a* (a +z direction side) and the conductor 56 may be located closer to the conductor 12*b* (a +z direction side).

The conductor 19 is a linear conductor having an end part 19*a* which is one end, and an end part 19*b* which is the other end. The end part 19*a* is connected to the electrode 55, and the end part 19*b* is exposed to an outside of the conductor 11 through a through hole 41 formed in the conductor 11.

The conductor 20 is a linear conductor having an end part 20*a* which is one end, and an end part 20*b* which is the other end. The end part 20*a* is connected to the electrode 56, and the end part 20*b* is exposed to an outside of the conductor 11 through a through hole 42 formed in the conductor 11.

In the thereby constructed dielectric filter according to this embodiment, for example, upon input of an electric signal from the end part 19*b* of the conductor 19, resonance occurs in the two resonators, and an electric signal is outputted from the end part 20*b* of the conductor 20. At this time, due to the selective passage of signals lying in a frequency band including the resonance frequencies of the two resonators, the dielectric filter functions as a band-pass filter.

The dielectric filter according to this embodiment is constituted by the resonator which provides a high Q in fundamental mode resonance, and features a wide gap between a resonance frequency in a fundamental mode and a resonance frequency in a spurious mode. This makes it possible to attain excellent electrical characteristics involving little insertion loss in a pass band and high attenuation in the vicinity of the pass band.

Moreover, in the dielectric filter according to this embodiment, the third direction (the +x direction) in which the conductor 14*a* and the conductor 14*b* are disposed and the fourth direction (the +x direction) in which the conductor 15*a* and the conductor 15*b* are disposed coincide with each other, and, the plurality of sets are disposed along a fifth direction (the +y direction) which is perpendicular to both of the first direction (the +z direction) and the third direction (the +x direction). This makes it possible to maintain electromagnetic coupling between the sets and electromagnetic coupling between a set and an input-output line satisfactorily even if the number of the sets is increased, and thereby obtain a dielectric filter having satisfactory electrical characteristics. Note that the third direction and the fourth direction do not necessarily have to coincide with each other, and thus, for example, the third direction and the fourth direction may be defined as opposite directions.

Moreover, in the dielectric filter according to this embodiment, the electrode 55 is disposed within the dielectric body 70*a* so as to be located closer to one of the end in the first direction and the end in the second direction of the dielectric body 70*a* (the end in the second direction (−z direction) in FIGS. 11 to 13), and, the end part 19*a* of the conductor 19 is connected to a part of the electrode 55 located closer to the other one of the end in the first direction and the end in the second direction thereof (the end in the first direction (+z direction) in FIGS. 11 to 13). This helps strengthen the electromagnetic coupling between the electrode 55 and the dielectric body 70*a*. Note that, even if the electrode 55 is disposed within the dielectric body 70*a* so as to be located closer to the end in the +z direction of the dielectric body 70*a*, and the end part 19*a* of the conductor 19 is connected to a part of the electrode 55 located closer to the end in the −z direction thereof, similar effects can be attained.

Likewise, in the dielectric filter according to this embodiment, the electrode 56 is disposed within the dielectric body 70*b* so as to be located closer to one of the end in the first direction and the end in the second direction of the dielectric body 70*b* (the end in the second direction (−z direction) in FIGS. 11 to 13), and, the end part 20*a* of the conductor 20 is connected to a part of the electrode 56 located closer to the other one of the end in the first direction and the end in the second direction thereof (the end in the first direction (+z direction) in FIGS. 11 to 13). This helps strengthen the electromagnetic coupling between the electrode 56 and the dielectric body 70*b*. Note that, even if the electrode 56 is disposed within the dielectric body 70*b* so as to be located closer to the end in the +z direction of the dielectric body 70*b*, and the end part 20*a* of the conductor 20 is connected to a part of the electrode 56 located closer to the end in the −z direction thereof, similar effects can be attained.

While the dielectric filter is illustrated as having two sets, namely the first set 51 and the second set 52 in this embodiment, a larger number of the sets may be provided therein. In this case, an additional set (or sets) may be disposed between the first set 51 and the second set 52. However, an increase in the number of the sets may lead to an increase in insertion loss and an increase in size, wherefore the number of the sets should preferably be not greater than 10.

(Sixth Embodiment)

Figure 14:
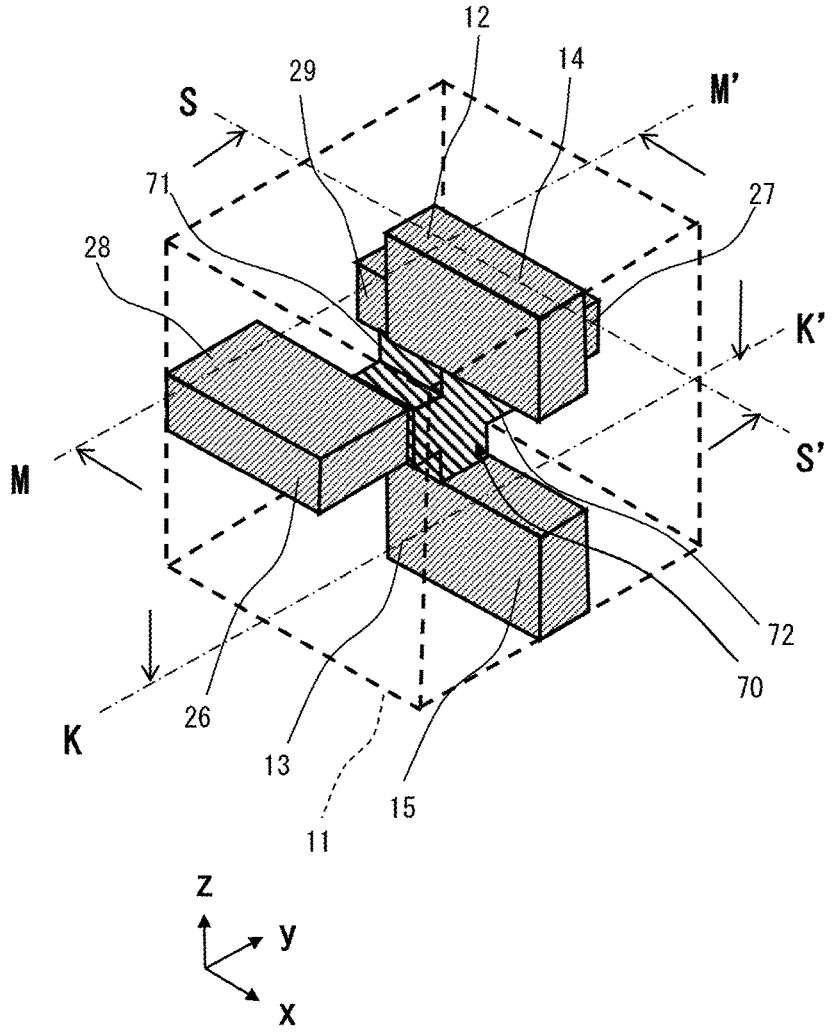
FIG. 14 is a perspective view schematically showing a dielectric resonator in accordance with a sixth embodiment of the invention.
Figure 15:
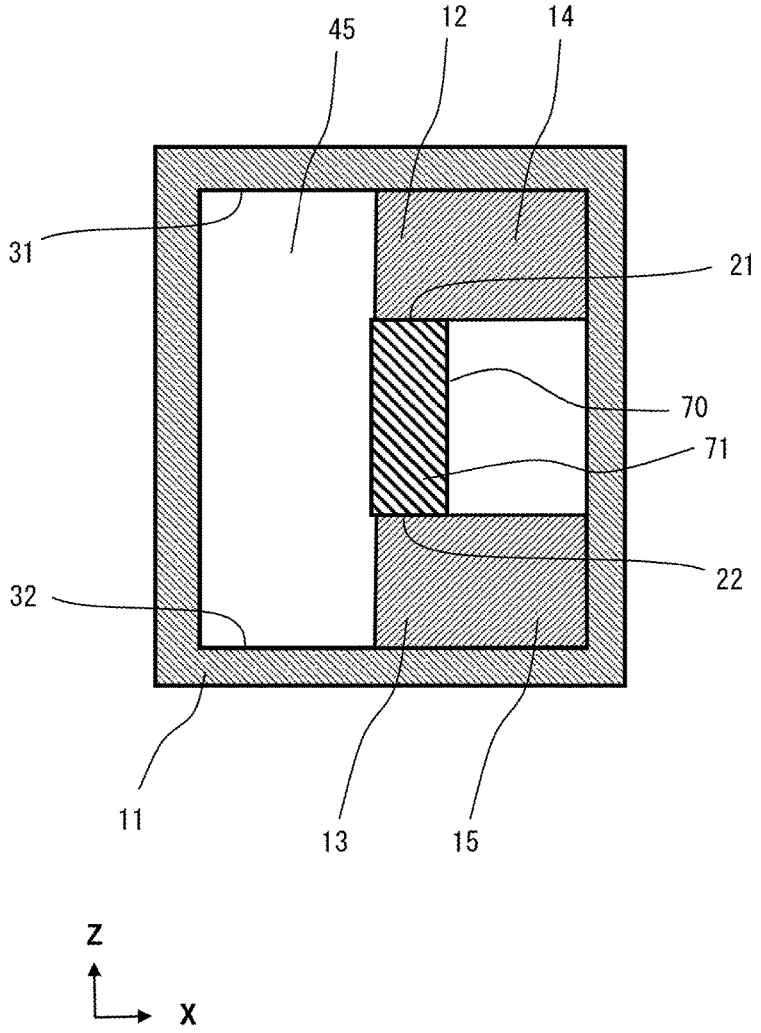
FIG. 15 is a sectional view of the dielectric resonator taken along the line S-S' shown in FIG. 14.
Figure 16:
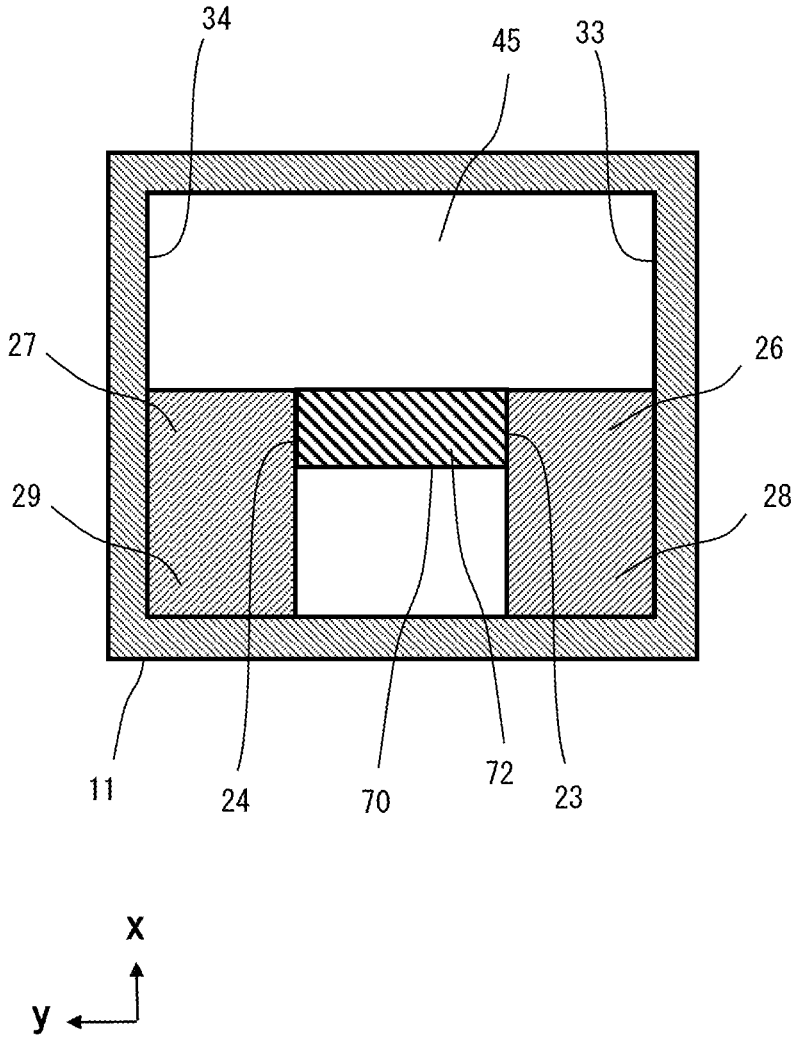
FIG. 16 is a sectional view of the dielectric resonator taken along the line K-K' shown in FIG. 14.
Figure 17:
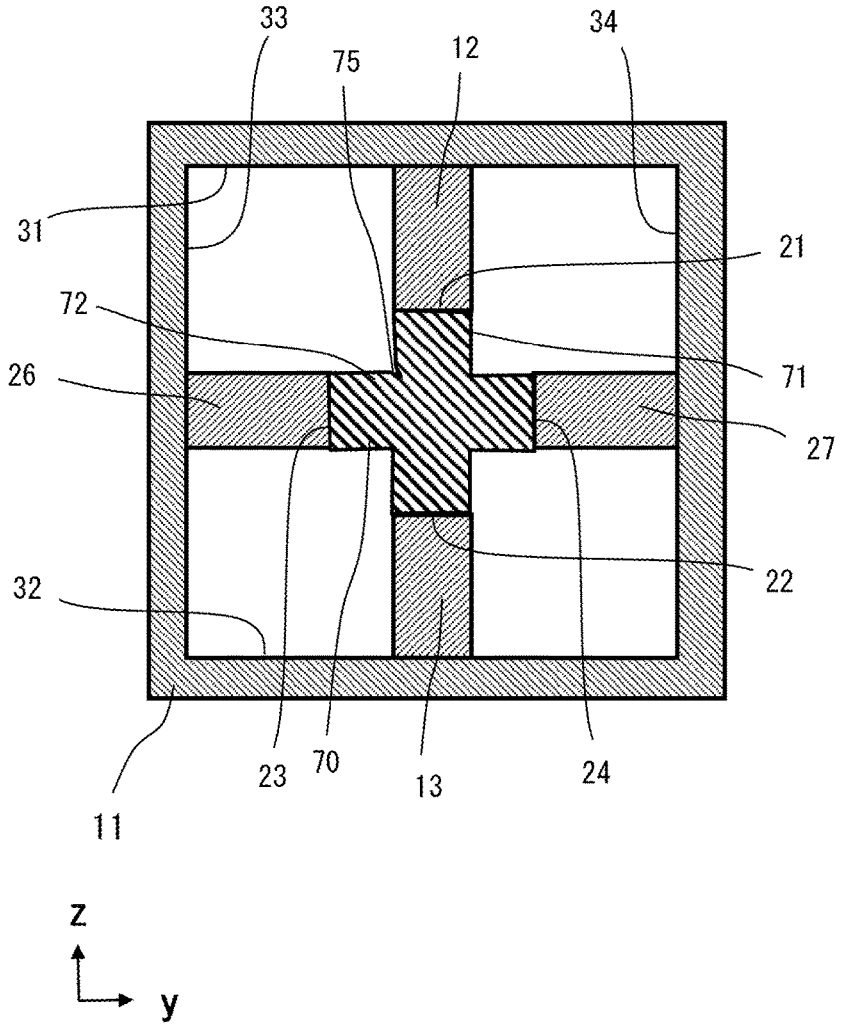
FIG. 17 is a sectional view of the dielectric resonator taken along the line M-M' shown in FIG. 14.

FIG. 14 is a perspective view schematically showing a dielectric resonator in accordance with a sixth embodiment of the invention. FIG. 15 is a sectional view of the dielectric resonator taken along the line S-S' shown in FIG. 14 (a view showing a section parallel to an x-z plane including the line S-S', the section dividing the conductor 11 into two equal portions in the +y direction, as seen from the −y direction). FIG. 16 is a sectional view of the dielectric resonator taken along the line K-K' shown in FIG. 14 (a view showing a section parallel to an x-y plane including the line K-K', the section dividing the conductor 11 into two equal portions in the +z direction, as seen from the +z direction). FIG. 17 is a sectional view of the dielectric resonator taken along the line M-M' shown in FIG. 14 (a view showing a section parallel to a y-z plane including the line M-M', the section dividing the conductor 11 into two equal portions in the +x direction, as seen from the +x direction). To simplify an understanding of the construction, a conductor 11 is represented in a see-through manner in FIG. 14. Moreover, the following description of this embodiment deals only with the points of difference from the foregoing first embodiment, and like constituent components will be identified with the same reference symbols, and overlapping descriptions will be omitted.

As shown in FIGS. 14 to 17, the dielectric resonator according to this embodiment comprises a conductor 26, a conductor 27, a conductor 28, and a conductor 29. Moreover, there is provided a dielectric body 70 composed of a first portion 71 and a second portion 72 disposed so as to intersect each other to define a cross shape.

The first portion 71 is a columnar portion which extends in the first direction (the +z direction), and has a surface 21 located at an end in the first direction (the +z direction) thereof and a surface 22 which is located at an end in the second direction (the −z direction) opposite to the first direction thereof. The second portion 72 is a columnar portion which extends in a fifth direction (a −y direction) perpendicular to the first direction, and has a surface 23 located at an end in the fifth direction (the −y direction) thereof and a surface 24 which is located at an end in a sixth direction (a +y direction) opposite to the fifth direction thereof.

The conductor 26 is a columnar conductor extending in the −y direction. Moreover, the conductor 26 is disposed on the surface 23 of the dielectric body 70. An end in the fifth direction (a −y direction) of the conductor 26 is joined to or brought into contact with an inner surface 33 of the conductor 11 for electrical connection with the inner surface 33 of the conductor 11.

The conductor 27 is a columnar conductor extending in the −y direction. Moreover, the conductor 27 is disposed on the surface 24 of the dielectric body 70. An end in the sixth direction (+y direction) of the conductor 27 is joined to or brought into contact with an inner surface 34 of the conductor 11 for electrical connection with the inner surface 34 of the conductor 11.

The conductor 28 is shaped in a cuboid. Moreover, the conductor 28 is disposed between the conductor 26 and the conductor 11 in a seventh direction (a −x direction) perpendicular to the first direction and the fifth direction. An end in the seventh direction (−x direction) of the conductor 28 is joined to or brought into contact with the conductor 11 for electrical connection with the conductor 11. An end of the conductor 28 opposite to the end in the seventh direction (the +x direction) is joined to or brought into contact with the conductor 26 for electrical connection with the conductor 26. An end in the fifth direction (−y direction) of the conductor 28 is joined to or brought into contact with the inner surface 33 of the conductor 11 for electrical connection with the inner surface 33 of the conductor 11.

The conductor 29 is shaped in a cuboid. Moreover, the conductor 29 is disposed between the conductor 27 and the conductor 11 in the seventh direction (the −x direction). An end in the seventh direction (−x direction) of the conductor 29 is joined to or brought into contact with the conductor 11 for electrical connection with the conductor 11. An end of the conductor 29 opposite to the end in the seventh direction (the +x direction) is joined to or brought into contact with the conductor 27 for electrical connection with the conductor 27. An end in the sixth direction (+y direction) of the conductor 29 is joined to or brought into contact with the inner surface 34 of the conductor 11 for electrical connection with the inner surface 34 of the conductor 11.

Moreover, as shown in FIG. 17, the dielectric body 70 is formed with a groove 75. The groove 75 is formed at the intersection of the first portion 71 and the second portion 72 so as to extend throughout the length of the construction in the +x direction. Such a groove 75 functions to dissolve degeneracy in two resonant modes, and, the shape of the groove 75 is adjusted properly in conformity with the desired characteristics.

While the conductor 12, the conductor 13, the conductor 26, and the conductor 27 are illustrated as being shaped in a quadrangular prism in this embodiment, the conductors may be given another shape, for example, the shape of a hexagonal prism or cylinder. However, it is preferable that the conductor 26 and the conductor 27 are identical with the second portion 72 in sectional profile taken along a plane perpendicular to the −y direction.

Moreover, the conductors 26 to 29 (the conductor 26, the conductor 27, the conductor 28, and the conductor 29) are similar to the conductors 12 to 15 (the conductor 12, the conductor 13, the conductor 14, and the conductor 15) in material, configuration, and the condition of bonding of each conductor with a corresponding adjacent component. In FIGS. 14 to 17, there is shown a case were the conductor 26 and the conductor 28 are formed integrally with each other, and the conductor 27 and the conductor 29 are formed integrally with each other.

The thereby constructed dielectric resonator according to this embodiment serves as a dual-mode resonator. Moreover, the dielectric resonator according to this embodiment has the conductor 12, the conductor 13, the conductor 26, and the conductor 27, and thus achieves a widening of a gap between a resonance frequency in a fundamental mode and a resonance frequency in a spurious mode in both of the two modes. Furthermore, in the dielectric resonator according to this embodiment having the conductor 14, the conductor 15, the conductor 28, and the conductor 29, as contrasted to a case where none of the conductor 14, the conductor 15, the conductor 28, and the conductor 29 is provided, it is possible to attain a higher Q in fundamental mode resonance.

As shown in FIGS. 14 and 16, it is preferable that the conductor 28 is disposed so as to extend throughout a region between the conductor 26 and the conductor 11 on the seventh direction (the −y direction) side from the conductor 26, as well as to extend throughout a region between the surface 23 and the inner surface 33 in the fifth direction (the −y direction). Moreover, it is preferable that the conductor 29 is disposed so as to extend between the conductor 27 and the conductor 11 on the seventh direction (the −x direction) side from the conductor 27, as well as to extend between the surface 24 and the inner surface 34 in the fifth direction (the −y direction). In this case, a magnetic field generated so as to surround the conductor 26 and the conductor 27 can be further reduced, and current loss in the conductor 26 and the conductor 27 can be further reduced accordingly, thus attaining a higher Q.

Moreover, in the dielectric resonator according to this embodiment, the third direction (the +x direction) and the seventh direction (the −x direction) are defined as opposite directions. That is, the direction in which the conductor 14 is disposed relative to the conductor 12 and the conductor 15 is disposed relative to the conductor 13 and the direction in which the conductor 28 is disposed relative to the conductor 26 and the conductor 29 is disposed relative to the conductor 27 are opposite directions. This makes it possible to prevent deterioration in electrical characteristics resulting from a decrease in the degree of symmetry of electromagnetic field distribution, as well as to obtain a dielectric resonator capable of easy electromagnetic coupling.

(Seventh Embodiment)

Figure 18:
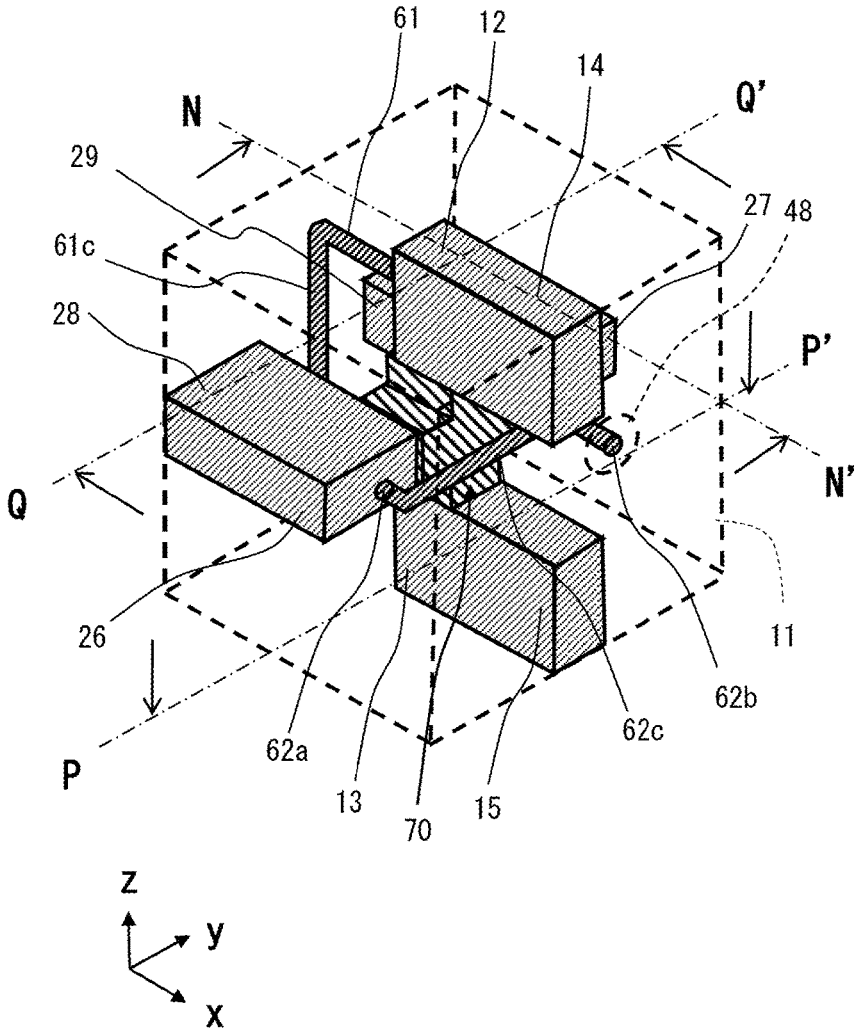
FIG. 18 is a perspective view schematically showing a dielectric filter in accordance with a seventh embodiment of the invention.
Figure 19:
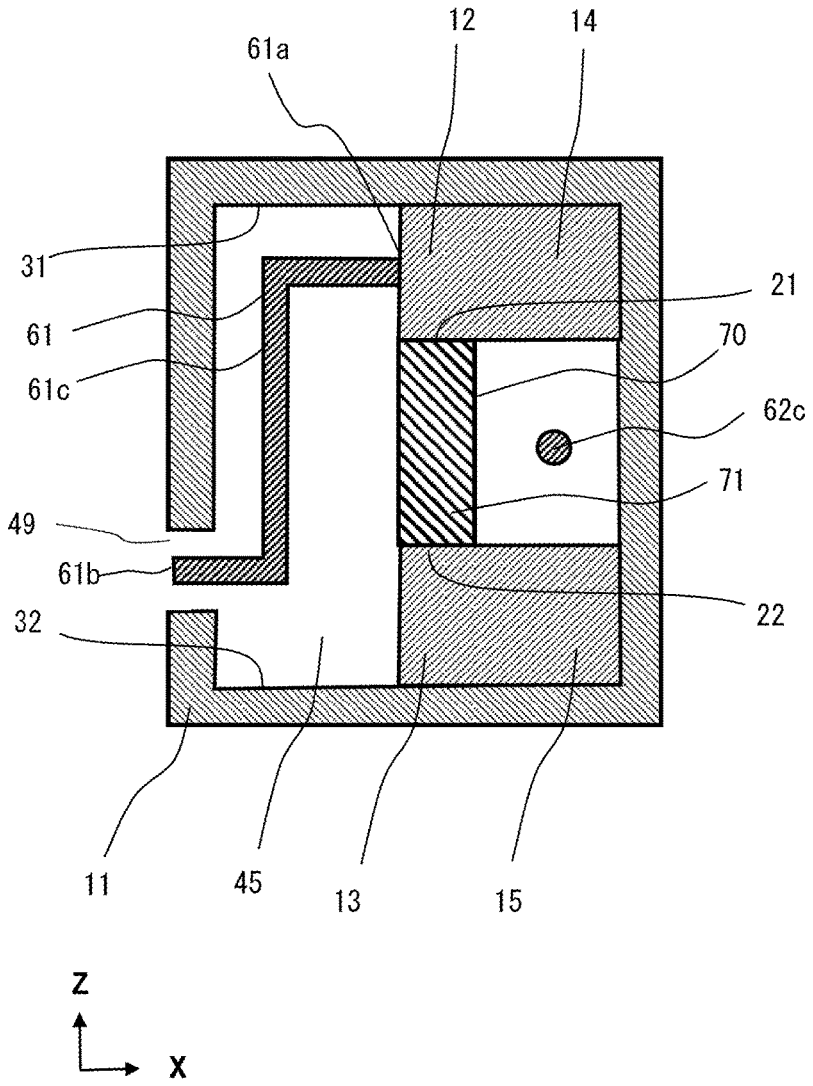
FIG. 19 is a sectional view of the dielectric filter taken along the line N-N' shown in FIG. 18.
Figure 20:
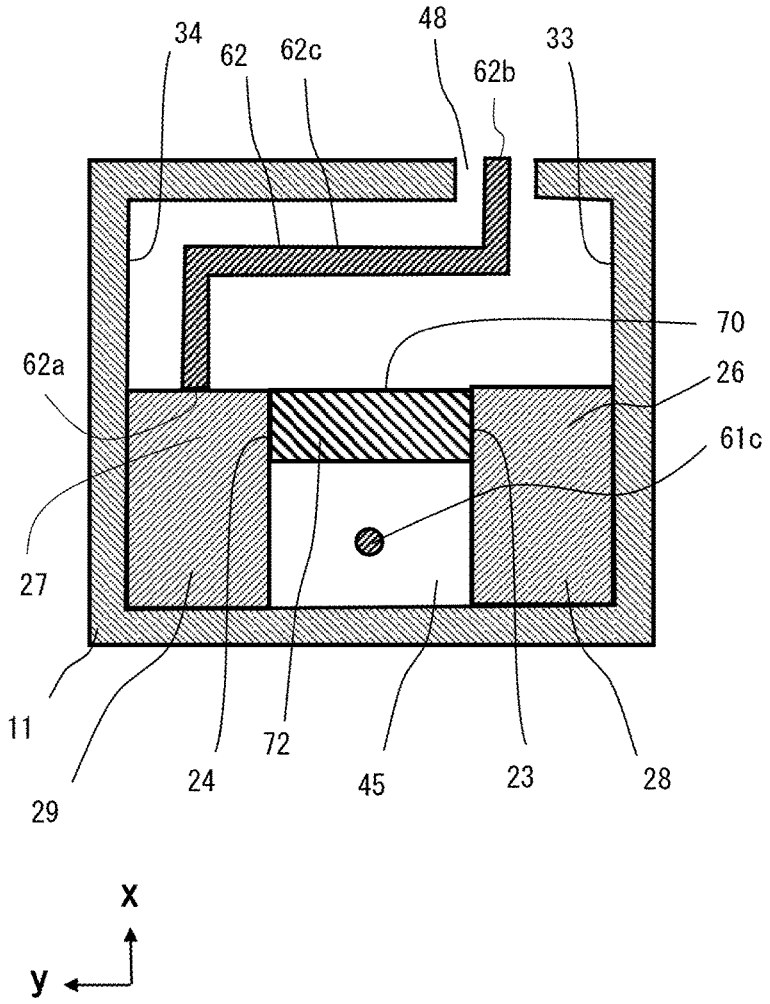
FIG. 20 is a sectional view of the dielectric filter taken along the line P-P' shown in FIG. 18.
Figure 21:
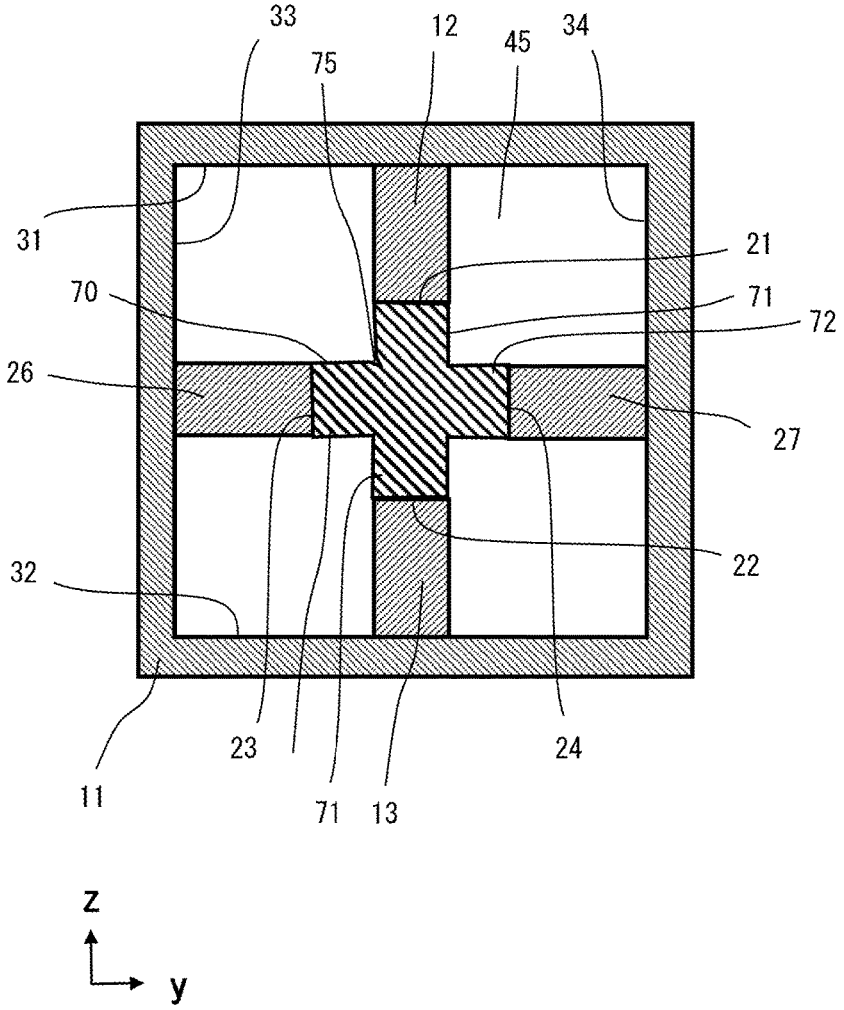
FIG. 21 is a sectional view of the dielectric filter taken along the line Q-Q' shown in FIG. 18.

FIG. 18 is a perspective view schematically showing a dielectric filter in accordance with a seventh embodiment of the invention. FIG. 19 is a sectional view of the dielectric filter taken along the line N-N' shown in FIG. 18 (a view showing a section parallel to an x-z plane including the line N-N' as seen from the −y direction). FIG. 20 is a sectional view of the dielectric filter taken along the line P-P' shown in FIG. 18 (a view showing a section parallel to an x-y plane including the line P-P' as seen from the +z direction). FIG. 21 is a sectional view of the dielectric filter taken along the line Q-Q' shown in FIG. 18 (a view showing a section parallel to an y-z plane including the line Q-Q' as seen from the +x direction). To simplify an understanding of the construction, a conductor 11 is represented in a see-through manner in FIG. 18. Moreover, the following description of this embodiment deals only with the points of difference from the foregoing sixth embodiment, and like constituent components will be identified with the same reference symbols, and overlapping descriptions will be omitted. As shown in FIGS. 18 to 21, the dielectric filter according to this embodiment comprises the dielectric resonator according to the foregoing sixth embodiment, a conductor 61, and a conductor 62.

The conductor 61 is a linear conductor having an end part 61*a* which is one end, an end part 61*b* which is the other end, and a joint part 61*c* extending along a first portion 71 in the first direction (the +z direction). The joint part 61*c* is coupled to the first portion 71 mainly via a magnetic field. The conductor 61 is electromagnetically coupled to the first portion 71. The end part 61*a* is connected to a conductor 12, and, the end part 61*b* is exposed to an outside of the conductor 11 through a through hole 49 formed in the conductor 11. The end part 61*a* may be connected to a conductor 13 instead of the conductor 12.

The conductor 62 is a linear conductor having an end part 62*a* which is one end, an end part 62*b* which is the other end, and a joint part 62*c* extending along a second portion 72 in the fifth direction (the −y direction). The joint part 62*c* is coupled to the second portion 72 mainly via a magnetic field. The conductor 62 is electromagnetically coupled to the first portion 72. The end part 62*a* is connected to a conductor 26, and, the end part 62*b* is exposed to an outside of the conductor 11 through a through hole 48 formed in the conductor 11. The end part 62*a* may be connected to a conductor 27 instead of the conductor 26.

While it is preferable that the joint part 61*c* is in parallel with the +z direction, the joint part 61*c* may be inclined with respect to the +z direction so long as it includes a +z direction component. Likewise, while it is preferable that the joint part 62*c* is in parallel with the −y direction, the joint part 62*c* may be inclined with respect to the −y direction so long as it includes a −y direction component. Moreover, the position and the length of each of the joint part 61*c* and the joint part 62*c* may be adjusted properly in conformity with the magnitude of the desired magnetic field coupling.

In the thereby constructed dielectric filter according to this embodiment, for example, upon input of an electric signal from the end part 61*b* of the conductor 61, resonance occurs in the dielectric body 70, and an electric signal is outputted from the end part 62*b* of the conductor 62. At this time, due to the selective passage of signals lying in a frequency band including resonance frequencies in the second resonant mode and the third resonant mode, the dielectric filter functions as a band-pass filter.

The dielectric filter according to this embodiment is constituted by the dielectric resonator which provides a high Q in fundamental mode resonance, and has excellent electrical characteristics involving a wide gap between a resonance frequency in a fundamental mode and a resonance frequency in a spurious mode. This makes it possible to obtain a dielectric filter having excellent electrical characteristics involving little insertion loss in a pass band and high attenuation in the vicinity of the pass band.

(Eighth Embodiment)

Figure 22:
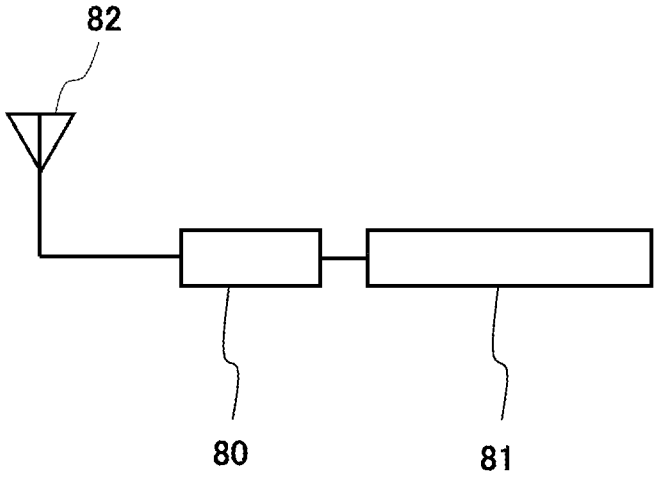
FIG. 22 is a block diagram schematically showing a communication apparatus in accordance with an eighth embodiment of the invention.

FIG. 22 is a block diagram schematically showing a communication apparatus in accordance with an eighth embodiment of the invention. The communication apparatus according to this embodiment comprises an antenna 82, a communication circuit 81, and a dielectric filter 80 configured to connect the antenna 82 with the communication circuit 81. The dielectric filter 80 is the dielectric filter according to the foregoing third embodiment. The antenna 82 and the communication circuit 81 are a well-known conventional antenna and a well-known conventional communication circuit, respectively.

In the thereby constructed communication apparatus according to this embodiment, unnecessary electric signals are removed by the dielectric filter according to the third embodiment having satisfactory electrical characteristics. Accordingly, a communication apparatus of high communication quality can be obtained.

Any one of the dielectric filter according to the fourth embodiment, the dielectric filter according to the fifth embodiment, the dielectric filter according to the seventh embodiment, and a dielectric filter of another form may be used instead of the dielectric filter according to the third embodiment.

EXAMPLES

The electrical characteristics of the dielectric resonator according to the first embodiment shown in FIGS. 1 to 3 were determined by simulation. In running the simulation, the relative permittivity and the dielectric loss tangent of a dielectric constituting the dielectric body 70 were set at 60 and 0.00005, respectively. The electrical conductivity of the various conductors was set at $46.4\times10^6$ S/m. The inside shape of the conductor 11 (the outside shape of the cavity 45) was defined by a rectangular prism, the dimension in the +x direction of which was 20 mm, the dimension in the +y direction of which was 20 mm, and the dimension in the +z direction of which was 24 mm. The dielectric body 70 was given a columnar form which was 4.4 mm in dimension in the +x direction, was 4.4 mm in dimension in the +y direction, and was 10 mm in dimension in the +z direction. The conductor 12 and the conductor 13 were equal to the dielectric body 70 in dimension in the +x direction and in dimension in the +y direction. Moreover, the conductor 12 and the conductor 13 had the same shape, and the conductor 14 and the conductor 15 had the same shape. The result of the simulation showed that the resonance frequency of the fundamental mode was 2.077 GHz, the Q value was 3540, and the resonance frequency of the spurious mode with the lowest frequency was 5.790 GHz.

Figure 25:
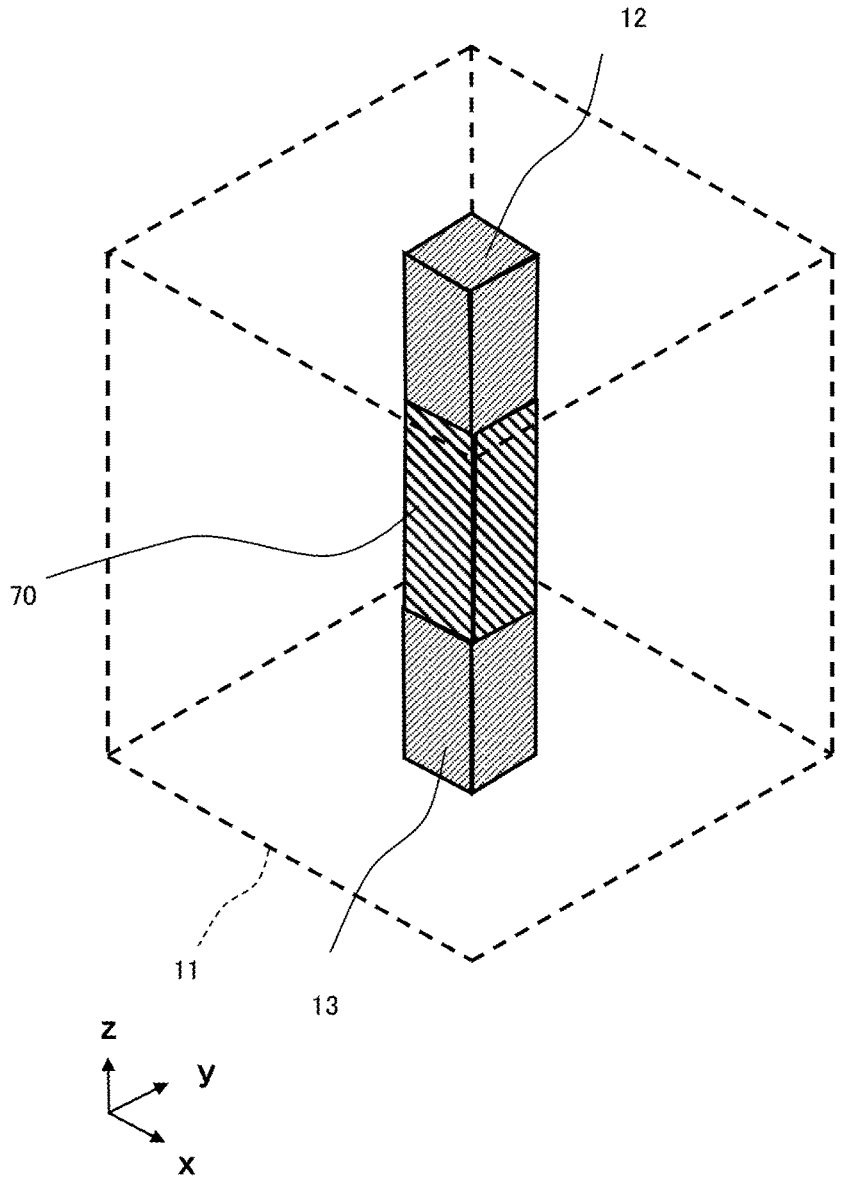
FIG. 25 is a perspective view schematically showing a dielectric resonator implemented as a first comparative example.

Moreover, the electrical characteristics of a dielectric resonator of a first comparative example shown in FIG. 25 were determined by simulation. As shown in FIG. 25, the dielectric resonator of the first comparative example had a form obtained by removing the conductor 14 and the conductor 15 from the dielectric resonator according to the first embodiment. To render the resonance frequency of the fundamental mode substantially coincident with that in the first embodiment, the dimension in the +x direction and the dimension in the +y direction of the dielectric body 70 were each set at 3.6 mm. The result of the simulation showed that the resonance frequency of the fundamental mode was 2.037 GHz, the Q value was 3199, and the resonance frequency of the spurious mode with the lowest frequency was 6.273 GHz.

Figure 26:
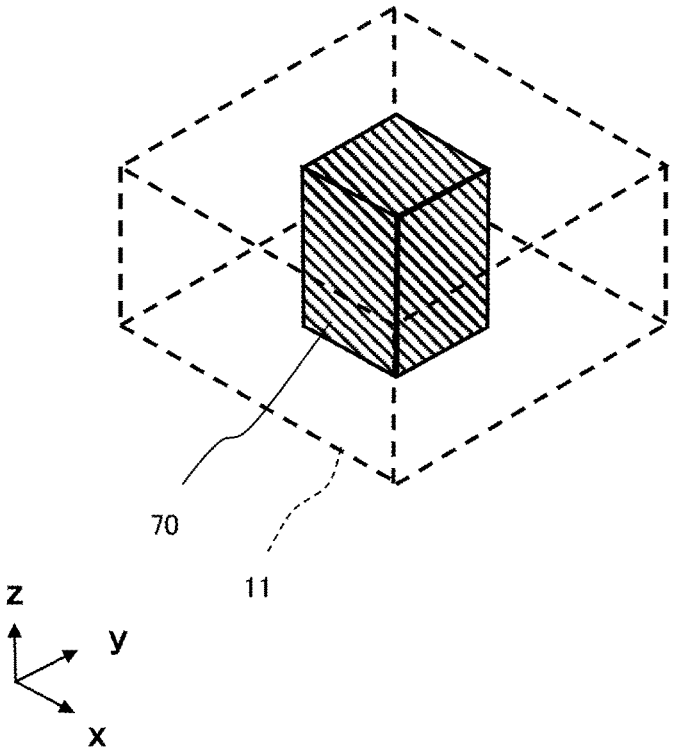
FIG. 26 is a perspective view schematically showing a dielectric resonator implemented as a second comparative example.

Moreover, the electrical characteristics of a dielectric resonator of a second comparative example shown in FIG. 26 were determined by simulation. As shown in FIG. 26, the dielectric resonator of the second comparative example had a form obtained by removing the conductor 12, the conductor 13, the conductor 14, and the conductor 15 from the dielectric resonator according to the first embodiment. This form is identical with the form of the conventional dielectric resonator. Moreover, to render the resonance frequency of the fundamental mode substantially coincident with that in the first embodiment, the dimension in the +y direction and the dimension in the +x direction of the dielectric body 70 were each set at 6.5 mm, and the dimensions in the +z direction of the cavity 45 and the dielectric body 70 were each set at 10 mm. The result of the simulation showed that the resonance frequency of the fundamental mode was 2.044 GHz, the Q value was 4000, and the resonance frequency of the spurious mode with the lowest frequency was 4.200 GHz.

According to these results, the resonator of the second comparative example which is the conventional resonator presents a serious problem arising from low level of the resonance frequency of the spurious mode with the lowest frequency, and, the dielectric resonator of the first comparative example presents a serious problem arising from low level of Q in fundamental mode resonance. On the other hand, the dielectric resonator according to the first embodiment has a high Q in fundamental mode resonance and a high resonance frequency of the spurious mode with the lowest frequency, and thus affords defect-free, well-balanced, and excellent electrical characteristics. Thus, advantageous effects of the invention can be confirmed.

Figure 23:
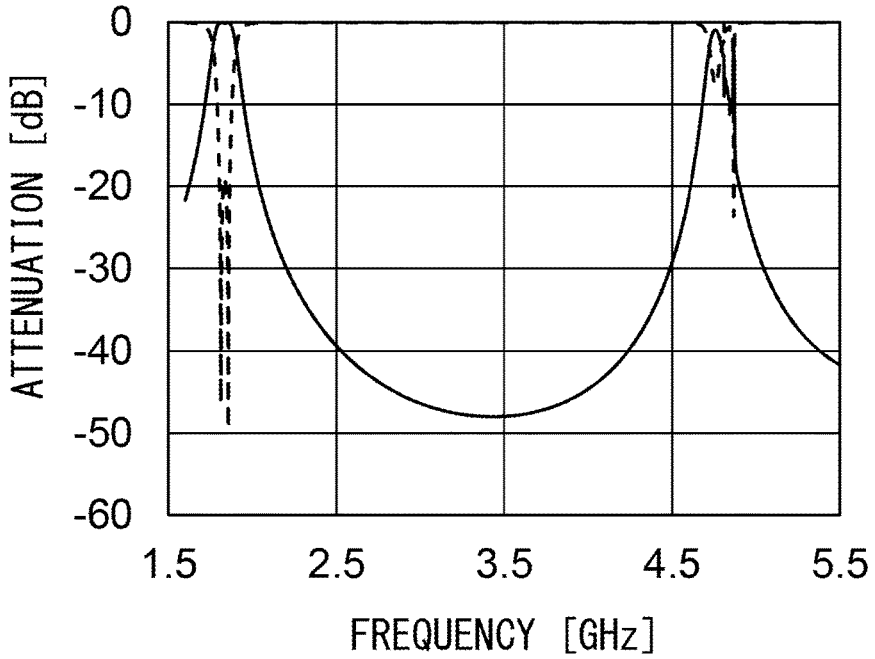
FIG. 23 is a graph indicating the result of simulation on the dielectric filter in accordance with the third embodiment of the invention in respect of electrical characteristics.

Moreover, the electrical characteristics of the dielectric filter according to the third embodiment shown in FIGS. 5 to 7 were determined by simulation. In running the simulation, the relative permittivity and the dielectric loss tangent of a dielectric constituting the dielectric body 70 were set at 60 and 0.00005, respectively. The electrical conductivity of the various conductors was set at $46.4\times10^6$ S/m. The inside shape of the conductor 11 (the outside shape of the cavity 45) was defined by a rectangular prism, the dimension in the +x direction of which was 20 mm, the dimension in the +y direction of which was 42 mm, and the dimension in the +z direction of which was 26 mm. The dielectric body 70*a* and the dielectric body 70*b* were shaped in a cylinder which was 6 mm in diameter and was 10 mm in dimension in the +z direction. The conductor 12*a*, the conductor 12*b*, the conductor 13*a*, and the conductor 13*b* were equal to the dielectric body 70*a* and the dielectric body 70*b* in dimension in the +x direction and in dimension in the +y direction. Moreover, the conductor 12*a*, the conductor 12*b*, the conductor 13*a*, and the conductor 13*b* had the same shape, and the conductor 14*a*, the conductor 14*b*, the conductor 15*a*, and the conductor 15*b* had the same shape. The result of the simulation is indicated in the graph shown in FIG. 23. In the graph, the abscissa axis represents frequency, and the ordinate axis represents attenuation. It will be seen from the graph that excellent electrical characteristics involving little insertion loss in a pass band and high attenuation in the vicinity of the pass band have been obtained. Also from the graph, effectiveness of the invention can be confirmed.

Figure 24:
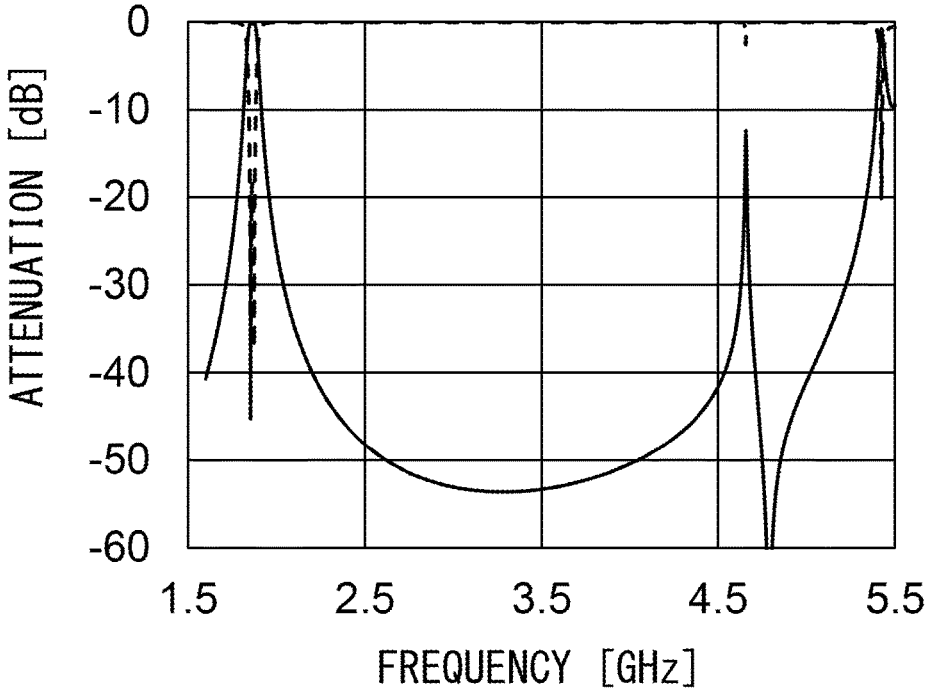
FIG. 24 is a graph indicating the result of simulation on the dielectric filter in accordance with the fourth embodiment of the invention in respect of electrical characteristics.

Moreover, the electrical characteristics of the dielectric filter according to the fourth embodiment shown in FIGS. 8 to 10 were determined by simulation. In running the simulation, the relative permittivity and the dielectric loss tangent of a dielectric constituting the dielectric body 70 were set at 60 and 0.00005, respectively. The electrical conductivity of the various conductors was set at $46.4\times10^6$ S/m. The inside shape of the conductor 11 (the outside shape of the cavity 45) was defined by a rectangular prism, the dimension in the +x direction of which was 20 mm, the dimension in the +y direction of which was 42 mm, and the dimension in the +z direction of which was 26 mm. The dielectric body 70*a* and the dielectric body 70*b* were shaped in a quadrangular prism which was 4.4 mm in dimension in the +x direction, was 4.4 mm in dimension in the +y direction, and was 10 mm in dimension in the +z direction. The conductor 12*a*, the conductor 12*b*, the conductor 13*a*, and the conductor 13*b* were equal to the dielectric body 70*a* and the dielectric body 70*b* in dimension in the +x direction and in dimension in the +y direction. Moreover, the conductor 12*a*, the conductor 12*b*, the conductor 13*a*, and the conductor 13*b* had the same shape, and the conductor 14*a*, the conductor 14*b*, the conductor 15*a*, and the conductor 15*b* had the same shape. The result of the simulation is indicated in the graph shown in FIG. 24. In the graph, the abscissa axis represents frequency, and the ordinate axis represents attenuation. According to the graph, it will be seen that there have been obtained excellent electrical characteristics involving little insertion loss in a pass band and even higher attenuation on the higher frequency side than the pass band. Also from the graph, effectiveness of the invention can be confirmed.

Moreover, the electrical characteristics of the dielectric filter according to the fifth embodiment shown in FIGS. 11 to 13 were determined by simulation. In running the simulation, the relative permittivity and the dielectric loss tangent of a dielectric constituting the dielectric body 70 were set at 60 and 0.00005, respectively. The electrical conductivity of the various conductors (the conductor 11, the conductor 12*a*, the conductor 12*b*, the conductor 13*a*, the conductor 13*b*, the conductor 14*a*, the conductor 14*b*, the conductor 15*a*, the conductor 15*b*, the conductor 19, and the conductor 20), the electrode 55, and the electrode 56 was set at $46.4\times10^6$ S/m. The inside shape of the conductor 11 (the outside shape of the cavity 45) was defined by a rectangular prism, the width (the dimension in the +x direction) of which was 20 mm, the length (the dimension in the +y direction) of which was 42 mm, and the height (the dimension in the +z direction) of which was 26 mm. The dielectric body 70*a* and the dielectric body 70*b* were shaped in a quadrangular prism which was 3.9 mm in length, was 3.9 mm in width, and was 10 mm in height. The conductor 12*a*, the conductor 12*b*, the conductor 13*a*, and the conductor 13*b* were equal in length and width to the dielectric body 70*a* and the dielectric body 70*b*. Moreover, the conductor 12*a*, the conductor 12*b*, the conductor 13*a*, and the conductor 13*b* had the same shape, and the conductor 14*a*, the conductor 14*b*, the conductor 15*a*, and the conductor 15*b* had the same shape. The result of the simulation is indicated in the graph shown in FIG. 27.

Figure 28:
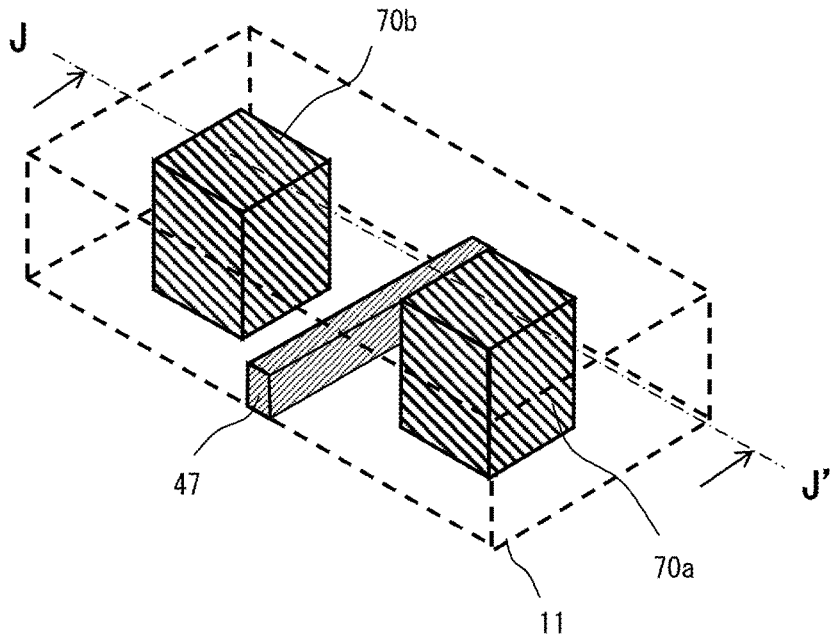
FIG. 28 is a perspective view schematically showing a dielectric filter implemented as a third comparative example.
Figure 29:
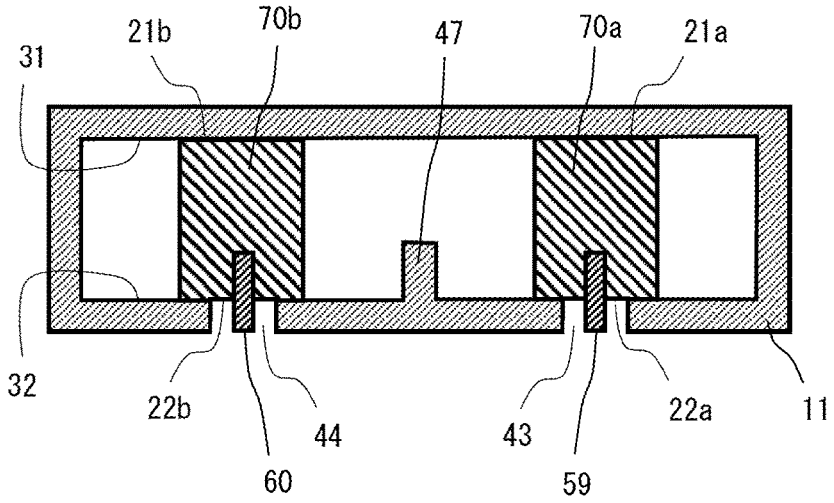
FIG. 29 is a sectional view of the dielectric filter taken along the line J-J' shown in FIG. 28.

Moreover, the electrical characteristics of a dielectric filter of a third comparative example shown in FIGS. 28 and 29 were determined by simulation. FIG. 28 is a perspective view schematically showing a dielectric filter of the third comparative example. FIG. 29 is a sectional view of the dielectric filter taken along the line J-J' shown in FIG. 28. To simplify an understanding of the construction, a conductor 11 is represented in a see-through manner in FIG. 28. The dielectric filter of the third comparative example had a form obtained by removing the conductor 12*a*, the conductor 12*b*, the conductor 13*a*, the conductor 13*b*, the conductor 14*a*, the conductor 14*b*, the conductor 15*a*, the conductor 15*b*, the conductor 19, and the conductor 20 from the dielectric filter according to the fifth embodiment shown in FIGS. 11 to 13, and, in this construction, a conductor 59 was inserted into the dielectric body 70*a* through a through hole 43 formed in the conductor 11, and a conductor 60 was inserted into the dielectric body 70*b* through a through hole 44 formed in the conductor 11. The inside shape of the conductor (the outside shape of the cavity 45) was defined by a rectangular prism, the width of which is 20 mm, the length of which was 42 mm, and the height of which was 10 mm. The dielectric body 70*a* and the dielectric body 70*b* were shaped in a quadrangular prism which is 7.8 mm in length, was 7.8 mm in width, and was 10 mm in height. The result of the simulation is indicated in the graph shown in FIG. 30.

Figure 27:
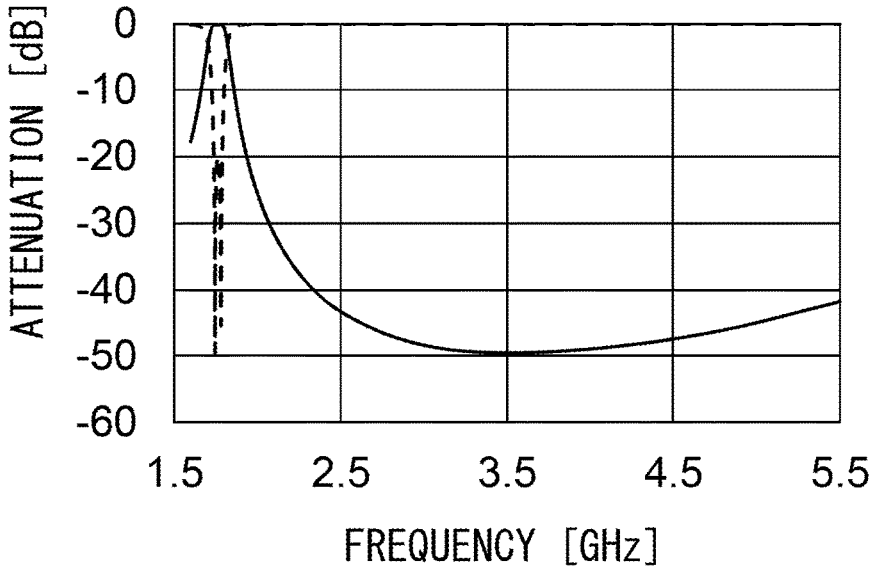
FIG. 27 is a graph indicating the result of simulation on the dielectric filter in accordance with the fifth embodiment of the invention in respect of electrical characteristics.
Figure 30:
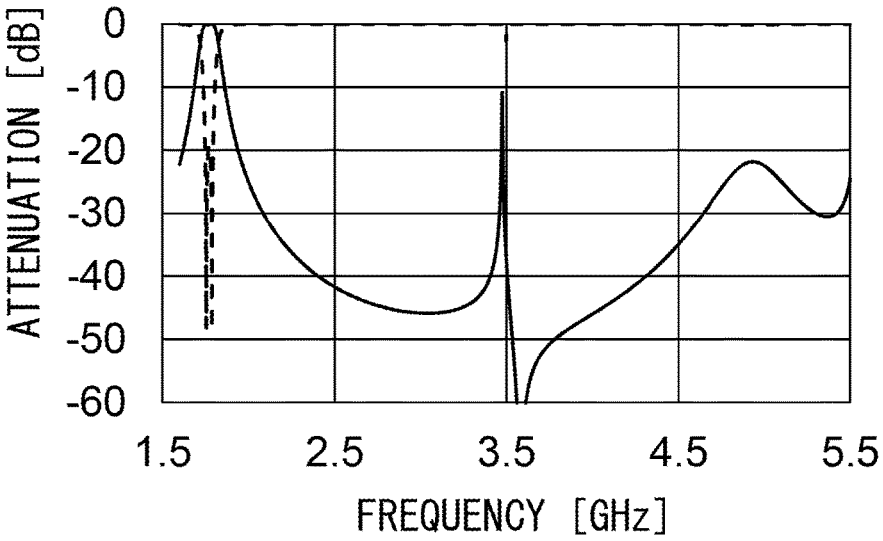
FIG. 30 is a graph indicating the result of simulation on the dielectric filter implemented as the third comparative example in respect of electrical characteristics.

In the graphs shown in FIGS. 27 and 30, the abscissa axis represents frequency, and the ordinate axis represents attenuation. According to the graph shown in FIG. 30, it will be seen that, in the dielectric filter of the third comparative example, a peak resulting from spurious mode resonance appeared in the vicinity of 5 GHz with consequent insufficiency in attenuation in the vicinity of the pass band. On the other hand, according to the graph shown in FIG. 27, it will be seen that, in the dielectric filter according to the fifth embodiment, there have been obtained excellent electrical characteristics involving little insertion loss in the pass band, and high attenuation in the vicinity of the pass band due to the shift of the peak resulting from spurious mode resonance toward the high frequency side. Also from this result, effectiveness of the invention can be confirmed.

REFERENCE SIGNS LIST

11, 12, 13, 14, 15, 16, 17, 18, 19, 20, 26, 27, 28, 29, 61, 62: Conductor
41, 42, 48, 49: Through hole
45: Cavity
55, 56, 57, 58: Electrode
70: Dielectric body
71: First portion
72: Second portion
80: Dielectric filter
81: Communication circuit
82: Antenna

The invention claimed is:

1. A dielectric resonator, comprising:

a dielectric body having a first surface located at an end in a first direction thereof and a second surface which is located at an end in a second direction opposite to the first direction thereof;

a first conductor having a cavity formed therein in which the dielectric body is housed, the first conductor being disposed so as to surround the dielectric body leaving space therefrom, and having a first inner surface including a part opposed to the first surface, and a second inner surface including a part opposed to the second surface;

a second conductor disposed on the first surface, an end in the first direction thereof being electrically connected to the first inner surface;

a third conductor disposed on the second surface, an end in the second direction thereof being electrically connected to the second inner surface;

a fourth conductor disposed between the second conductor and the first conductor in a third direction perpendicular to the first direction, an end in the first direction thereof and an end in the third direction thereof being electrically connected to the first conductor, an end in a direction opposite to the third direction thereof being electrically connected to the second conductor; and a fifth conductor disposed between the third conductor and the first conductor in a fourth direction perpendicular to the first direction, an end in the fourth direction thereof and an end in the second direction thereof being electrically connected to the first conductor, an end in a direction opposite to the fourth direction thereof being electrically connected to the third conductor.

2. The dielectric resonator according to claim 1, wherein the third direction and the fourth direction coincide with each other.

3. The dielectric resonator according to claim 2, further comprising:

an eleventh conductor;

a twelfth conductor;

a thirteenth conductor; and a fourteenth conductor;

wherein, when a direction perpendicular to both of the first direction and the third direction is a fifth direction, that a direction opposite to the fifth direction is a sixth direction, and that a direction opposite to the third direction is a seventh direction, the dielectric body includes a first portion disposed between the first surface and the second surface, the first portion having a columnar form elongated in the first direction, and a second portion disposed between a third surface located at an end in the fifth direction of the dielectric body and a fourth surface located at an end in the sixth direction of the dielectric body, the second portion having a columnar form, the first portion and the second portion being disposed so as to intersect each other to define a cross shape, the first conductor has a third inner surface including a part opposed to the third surface, and a fourth inner surface including a part opposed to the fourth surface, the eleventh conductor is disposed on the third surface, of which an end in the fifth direction is electrically connected to the third inner surface, the twelfth conductor is disposed on the fourth surface, of which an end in the sixth direction is electrically connected to the fourth inner surface, the thirteenth conductor is disposed between the eleventh conductor and the first conductor in the seventh direction, of which an end in the seventh direction and an end in the fifth direction are electrically connected to the first conductor, and of which an end in the third direction is electrically connected to the eleventh conductor, and the fourteenth conductor is disposed between the twelfth conductor and the first conductor in the seventh direction, of which an end in the seventh direction and an end in the sixth direction are electrically connected to the first conductor, and of which an end in the third direction is electrically connected to the twelfth conductor.

4. A dielectric filter, comprising:

the dielectric resonator according to claim 3;

a fifteenth conductor which is a linear conductor having a ninth end part which is one end, and a tenth end part which is the other end, the ninth end part being connected to the second conductor or the third conductor, the tenth end part being exposed to an outside of the first conductor through a first through hole formed in the first conductor, the fifteenth conductor being electromagnetically coupled to the first portion; and a sixteenth conductor which is a linear conductor having an eleventh end part which is one end, and a twelfth end part which is the other end, the eleventh end part being connected to the eleventh conductor or the twelfth conductor, the twelfth end part being exposed to an outside of the first conductor through a second through hole formed in the first conductor, the sixteenth conductor being electromagnetically coupled to the second portion.

5. A communication apparatus, comprising:

an antenna;

a communication circuit; and the dielectric filter according to claim 4, the dielectric filter being configured to connect the antenna with the communication circuit.

6. A dielectric filter, comprising:

a plurality of sets each composed of the dielectric body, the second conductor, the third conductor, the fourth conductor, and the fifth conductor of the dielectric resonator according to claim 1, the plurality of sets being disposed in the cavity and being aligned in a line, the plurality of sets including at least a first set disposed at one end of the line and a second set disposed at the other end of the line;

a sixth conductor which is a linear conductor having a first end part which is one end, and a second end part which is the other end, the first end part being connected to the second conductor or the third conductor of the first set, the second end part being exposed to an outside of the first conductor through a first through hole formed in the first conductor, the sixth conductor being electromagnetically coupled to the dielectric body of the first set; and a seventh conductor which is a linear conductor having a third end part which is one end, and a fourth end part which is the other end, the third end part being connected to the second conductor or the third conductor of the second set, the fourth end part being exposed to an outside of the first conductor through a second through hole formed in the first conductor, the seventh conductor being electromagnetically coupled to the dielectric body of the second set.

7. The dielectric filter according to claim 6, wherein the third direction and the fourth direction coincide with each other, and the plurality of sets are disposed along a fifth direction which is perpendicular to both of the first direction and the third direction.

8. The dielectric filter according to claim 6, further comprising:

a first electrode disposed within the dielectric body of the first set so as to be closer to one of the second conductor and the third conductor of the first set;

a second electrode disposed within the dielectric body of the second set so as to be closer to one of the second conductor and the third conductor of the second set; and an eighth conductor configured to connect the first electrode and the second electrode.

9. A communication apparatus, comprising:

an antenna;

a communication circuit; and the dielectric filter according to claim 6, the dielectric filter being configured to connect the antenna with the communication circuit.

10. A dielectric filter, comprising:

a plurality of sets each composed of the dielectric body, the second conductor, the third conductor, the fourth conductor, and the fifth conductor of the dielectric resonator according to claim 1, the plurality of sets being disposed in the cavity and being aligned in a line, the plurality of sets including at least a first set disposed at one end of the line and a second set disposed at the other end of the line;

a third electrode disposed within the dielectric body of the first set so as to be closer to one of the second conductor and the third conductor of the first set;

a fourth electrode disposed within the dielectric body of the second set so as to be closer to one of the second conductor and the third conductor of the second set;

a ninth conductor which is a linear conductor having a fifth end part which is one end, and a sixth end part which is the other end, the fifth end part being connected to the third electrode, the sixth end part being exposed to an outside of the first conductor through a first through hole formed in the first conductor; and a tenth conductor which is a linear conductor having a seventh end part which is one end, and an eighth end part which is the other end, the seventh end part being connected to the fourth electrode, the eighth end part being exposed to an outside of the first conductor through a second through hole formed in the first conductor.

11. The dielectric filter according to claim 10, wherein the third electrode is disposed within the dielectric body of the first set so as to be located at a position biased to one of the first direction and the second direction in the dielectric body of the first set, and the fifth end part is connected to a position biased to the other one of the first direction and the second direction of the third electrode.

12. The dielectric filter according to claim 10, wherein the fourth electrode is disposed within the dielectric body of the second set so as to be located at a position biased to one of the first direction and the second direction in the dielectric body of the second set, and the seventh end part is connected to a position biased to the other one of the first direction and the second direction of the fourth electrode.

13. The dielectric filter according to claim 10, wherein the third direction and the fourth direction coincide with each other, and the plurality of sets are disposed along a fifth direction which is perpendicular to both of the first direction and the third direction.

14. A communication apparatus, comprising:

an antenna;

a communication circuit; and the dielectric filter according to claim 10, the dielectric filter being configured to connect the antenna with the communication circuit.

* * * * *